US010613466B1

(12) United States Patent
Fukuda et al.

(10) Patent No.: US 10,613,466 B1
(45) Date of Patent: Apr. 7, 2020

(54) IMAGE FORMING APPARATUS

(71) Applicant: FUJI XEROX CO., LTD., Tokyo (JP)

(72) Inventors: Yusuke Fukuda, Kanagawa (JP); Takafumi Koide, Kanagawa (JP); Katsuyuki Kitajima, Kanagawa (JP); Yasuhisa Morooka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/551,842

(22) Filed: Aug. 27, 2019

(30) Foreign Application Priority Data

Mar. 1, 2019 (JP) ..... 2019-037497

(51) Int. Cl.
*G03G 21/10* (2006.01)

(52) U.S. Cl.
CPC ..... *G03G 21/105* (2013.01)

(58) Field of Classification Search
None
See application file for complete search history.

(56) References Cited

U.S. PATENT DOCUMENTS 6,040,104 A 3/2000 Nakamura et al.
8,559,863 B2 10/2013 Gonda et al.

FOREIGN PATENT DOCUMENTS

JP 11-194542 A 7/1999
JP 2011-145588 A 7/2011

*Primary Examiner* — Roy Y Yi
(74) *Attorney, Agent, or Firm* — Sughrue Mion, PLLC

(57) ABSTRACT

An image forming apparatus includes an image carrier; a charging unit that charges a surface of the image carrier; an electrostatic image forming unit that forms an electrostatic image on the charged surface of the image carrier; a developing unit that contains an electrostatic image developing toner and develops the electrostatic image formed on the surface of the image carrier with the electrostatic image developing toner to form a toner image; a transfer unit that transfers the toner image formed on the surface of the image carrier to a recording medium; a cleaning unit that removes the electrostatic image developing toner remaining on the surface of the image carrier; a first supply unit that has a replenishment toner transport path for transporting a replenishment toner for the electrostatic image developing toner and supplies the replenishment toner to the developing unit; a second supply unit that collects the electrostatic image developing toner removed by the cleaning unit, that has a collected toner transport path for transporting the collected toner to the developing unit, and that supplies the collected toner to the developing unit; and a fixing unit that fixes the toner image transferred to the recording medium. The electrostatic image developing toner contains toner particles and an external additive and satisfies the following inequalities: $(\ln \eta(T1)-\ln \eta(T2))/(T1-T2) \leq -0.14$, $(\ln \eta(T2)-\ln \eta(T3))/(T2-T3) \geq -0.15$, $(\ln \eta(T1)-\ln \eta(T2))/(T1-T2) < (\ln \eta(T2)-\ln \eta(T3))/(T2-T3)$, wherein $\eta(T1)$ represents a viscosity of the electrostatic image developing toner at 60° C., $\eta(T2)$ represents a viscosity of the electrostatic image developing toner at 90° C., and $\eta(T3)$ represents a viscosity of the electrostatic image developing toner at 130° C.

17 Claims, 3 Drawing Sheets

IMAGE FORMING APPARATUS

CROSS-REFERENCE TO RELATED APPLICATIONS

This application is based on and claims priority under 35 USC 119 from Japanese Patent Application No. 2019-037497 filed Mar. 1, 2019.

BACKGROUND

(i) Technical Field

The present disclosure relates to an image forming apparatus.

(ii) Related Art

Techniques such as electrophotography for visualization of image information via electrostatic images are currently used in various fields.

In the related art, electrophotography typically involves visualizing image information through a plurality of steps including forming an electrostatic image on a photoreceptor or an electrostatic recording medium using various techniques, developing the electrostatic image (toner image) by attaching electroscopic particles, which are called toner, to the electrostatic image, transferring the developed image onto a surface of a recording medium, and fixing the image by, for example, heating.

Japanese Laid Opened Patent Application Publication No. 2011-145588 discloses an image forming unit comprising an image carrier on which an electrostatic latent image is formed, a developing unit that develops the electrostatic latent image formed on the image carrier with a toner, a toner supply unit that supplies the toner to the developing unit, and a cleaning unit that removes and collects the residual toner on a surface of the image carrier after the toner image formed on the image carrier is transferred to a transfer medium.

The toner supply unit includes a tubular transport path and a toner-transporting rotation body that includes a first helical blade and a second helical blade wound in a helical direction opposite to the helical direction of the first helical blade, the first and second helical blades being formed in different regions along the axis of one single rotating shaft, and that is inserted into the tubular transport path and is configured to rotate such that the first and second helical blades transport the toner in directions facing each other. The rotating shaft is inclined at a given angle with respect to the horizontal plane such that the region where the second helical blade is formed is located above the region where the first helical blade is formed. The tubular transport path is provided with an inlet for unused toner at a lower inclined part of the region where the first helical blade is disposed, an inlet for toner collected by the cleaning unit at an upper inclined part of the region where the second helical blade is disposed, and a toner supply port for supplying transported toner to the developing unit at a position where toners transported by the drive of the first and second helical blades join together.

Japanese Laid Opened Patent Application Publication No. 11-194542 discloses an electrophotographic toner containing a binder resin and a coloring agent. The minimum tan δ of the binder resin is located between the glass transition temperature (Tg) of the resin and the temperature at which the loss modulus (G") of the resin reaches $1\times10^4$ Pa. The minimum tan δ is less than 1.2. The storage modulus (G') at the temperature corresponding to the minimum tan δ is greater than or equal to $5\times10^5$ Pa. The tan δ at the temperature at which the loss modulus (G") reaches $1\times10^4$ Pa is 3.0 or more.

SUMMARY

In the case of such an image forming apparatus in which an electrostatic image developing toner removed by a cleaning unit is collected and the collected electrostatic image developing toner is reused, when an image with a low area coverage (e.g., 1%) is formed in a high-temperature and high-humidity environment (e.g., 28° C. and 85% RH), the density of the image may decrease. When an image with a low area coverage (e.g., 30%) is formed in a low-temperature and low-humidity environment (e.g., 10° C. and 15% RH), unevenness in image density may occur.

Aspects of non-limiting embodiments of the present disclosure relate to an image forming apparatus in which an electrostatic image developing toner removed and collected by a cleaning unit is reused. When the image forming apparatus is used, a decrease in image density is less likely to occur when an image with a low area coverage is formed in a high-temperature and high-humidity environment, and unevenness in image density is less likely to occur when an image with a low area coverage is formed in a low-temperature and low-humidity environment, as compared to when an electrostatic image developing toner satisfying $(\ln \eta(T1)-\ln \eta(T2))/(T1-T2)>-0.14$ or $(\ln \eta(T2)-\ln \eta(T3))/(T2-T3)<-0.15$ is used.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including:

an image carrier;

a charging unit that charges a surface of the image carrier;

an electrostatic image forming unit that forms an electrostatic image on the charged surface of the image carrier;

a developing unit that contains an electrostatic image developing toner and develops the electrostatic image formed on the surface of the image carrier with the electrostatic image developing toner to form a toner image;

a transfer unit that transfers the toner image formed on the surface of the image carrier to a recording medium;

a cleaning unit that removes the electrostatic image developing toner remaining on the surface of the image carrier;

a first supply unit that has a replenishment toner transport path for transporting a replenishment toner for the electrostatic image developing toner and supplies the replenishment toner to the developing unit;

a second supply unit that collects the electrostatic image developing toner removed by the cleaning unit, that has a collected toner transport path for transporting the collected toner to the developing unit, and that supplies the collected toner to the developing unit; and a fixing unit that fixes the toner image transferred to the recording medium, wherein the electrostatic image developing toner contains toner particles and an external additive and satisfies inequalities below:

$(\ln \eta(T1)-\ln \eta(T2))/(T1-T2)\leq-0.14$ $(\ln \eta(T2)-\ln \eta(T3))/(T2-T3)\geq-0.15$ $(\ln \eta(T1)-\ln \eta(T2))/(T1-T2)<(\ln \eta(T2)-\ln \eta(T3))/(T2-T3)$ wherein $\eta(T1)$ represents a viscosity of the electrostatic image developing toner at 60° C., $\eta(T2)$ represents a viscosity of the electrostatic image developing toner at 90° C., and $\eta(T3)$ represents a viscosity of the electrostatic image developing toner at 130° C.

BRIEF DESCRIPTION OF THE DRAWINGS

Exemplary embodiments of the present disclosure will be described in detail based on the following figures, wherein.

DETAILED DESCRIPTION

Figure 1:
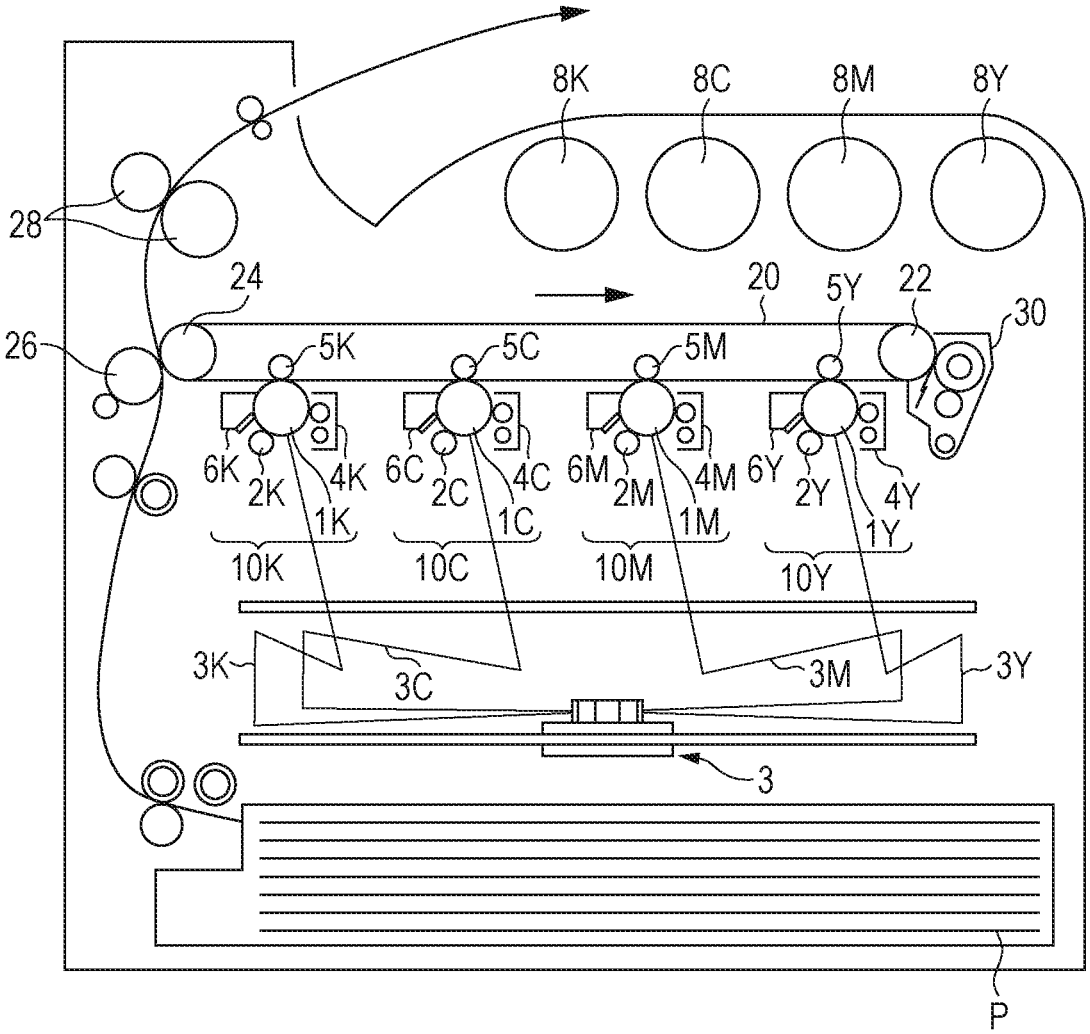
FIG. 1 is a schematic diagram illustrating an image forming apparatus according to an exemplary embodiment.

In this specification, if there are two or more substances corresponding to one component in a composition, the amount of the component in the composition refers to the total amount of the two or more substances in the composition, unless otherwise specified.

In this specification, "electrostatic image developing toner" is also referred to simply as "toner", and "electrostatic image developer" is also referred to simply as "developer".

Exemplary embodiments of the present disclosure will now be described.

Image Forming Apparatus

An image forming apparatus according to an exemplary embodiment will be described.

The image forming apparatus according to the exemplary embodiment includes an image carrier; a charging unit that charges a surface of the image carrier; an electrostatic image forming unit that forms an electrostatic image on the charged surface of the image carrier; a developing unit that contains an electrostatic image developer and develops the electrostatic image formed on the surface of the image carrier with the electrostatic image developer to form a toner image; a transfer unit that transfers the toner image formed on the surface of the image carrier to a surface of a recording medium; a cleaning unit that removes the electrostatic image developing toner remaining on the surface of the image carrier; a first supply unit that has a replenishment toner transport path for transporting a replenishment toner that is the electrostatic image developing toner and supplies the replenishment toner to the developing unit; a second supply unit that collects the electrostatic image developing toner removed by the cleaning unit, that has a collected toner transport path for transporting the collected toner to the developing unit, and that supplies the collected toner to the developing unit; and a fixing unit that fixes the toner image transferred to the surface of the recording medium.

As the electrostatic image developer, an electrostatic image developer containing a specific electrostatic image developing toner is used. The electrostatic image developing toner contains toner particles and an external additive. The electrostatic image developing toner satisfies $(\ln \eta(T1)-\ln \eta(T2))/(T1-T2)\geq-0.14$, $(\ln \eta(T2)-\ln \eta(T3))/(T2-T3)\geq-0.15$, and $(\ln \eta(T2)-\ln \eta(T3))/(T2-T3)>(\ln \eta(T1)-\ln \eta(T2))/(T1-T2)$, wherein $\eta(T1)$ is a viscosity $\eta$ of the toner at temperature T1=60° C., $\eta(T2)$ is a viscosity $\eta$ of the toner at temperature T2=90° C., and $\eta(T3)$ is a viscosity $\eta$ of the toner at temperature T3=130° C. The electrostatic image developing toner having these properties is also referred to simply as the "specific toner".

From the viewpoint of environmental protection, some electrophotographic image forming apparatuses are provided with mechanisms by which after a toner image is transferred, untransferred toner remaining on a surface of an electrophotographic image carrier (hereinafter also referred to as a "photoreceptor") serving as an image carrier is not disposed of but removed by a cleaning unit, the untransferred toner is collected, and the collected toner is transported to a developing device, a toner supplying device, or the like and recycled as a mixture with unused toner.

However, in the case of such an image forming apparatus in which an electrostatic image developing toner removed and collected by a cleaning unit is reused, when an image with a low area coverage (e.g., 1%) is formed in a high-temperature and high-humidity environment (e.g., 28° C. and 85% RH) by using a toner having excessively low viscoelasticity, the density of the image tends to decrease. This is probably due to the following reason. When collected toner removed and collected by the cleaning unit is supplied into a developing machine after a toner image is transferred, an external additive is likely to be buried in toner particles because the toner is subject to stress in the developing machine. When the collected toner is used as a mixture with unused toner, the toner particles tend to aggregate. Thus, the collected toner tends to adhere to the inside of a transport path, resulting in images with decreased image densities. Furthermore, when an image with a low area coverage is formed, a higher proportion of the toner is recycled with the external additive being buried in the toner particles. Thus, the collected toner tends to adhere to the inside of the transport path, and a decrease in image density tends to occur more notably.

On the other hand, in the case of the image forming apparatus in which collected toner is reused, when an image with a high area coverage (e.g., 30%) is formed in a low-temperature and low-humidity environment (e.g., 10° C. and 15% RH) by using a toner having excessively high viscoelasticity, unevenness in density tends to occur. This is probably due to the following reason. When collected toner removed and collected by the cleaning unit is supplied into the developing machine after a toner image is transferred, the external additive is likely to come off the toner particles because the toner is subject to stress in the developing machine. The collected toner in this state is more readily charged than unused toner. This results in a difference in charge between collected toner and unused toner, and unevenness in image density tends to occur due to the difference in charge. Furthermore, when an image with a low area coverage is formed, a higher proportion of the toner is recycled with the external additive coming off the toner particles, and thus the occurrence of unevenness in image density tends to be notable.

In the case of the image forming apparatus according to the exemplary embodiment, by using the above-described specific toner in an image forming apparatus having a configuration in which an electrostatic image developing toner removed and collected by a cleaning unit is reused, a decrease in image density is less likely to occur when an image with a low area coverage is formed in a high-temperature and high-humidity environment, and unevenness in image density is less likely to occur when an image with a low area coverage is formed in a low-temperature and low-humidity environment. The reason is presumed as follows.

First, the properties of the specific toner used in the exemplary embodiments will be described. The above expression $(\ln \eta(T1)-\ln \eta(T2))/(T1-T2)$ indicates the degree of change in viscosity of toner in the temperature range of 60° C. to 90° C., and if this value is −0.14 or less, it means that the toner shows a great change in viscosity in the range of 60° C. to 90° C. The above expression $(\ln \eta(T2)-\ln \eta(T3))/(T2-T3)$ indicates the degree of change in viscosity of toner in the temperature range of 90° C. to 120° C., and if this value is −0.15 or more, and $(\ln \eta(T2)-\ln \eta(T3))/(T2-T3)$ is more than $(\ln \eta(T1)-\ln \eta(T2))/(T1-T2)$, it means that the toner shows a small change in viscosity in the range of 90° C. to 120° C. That is, the specific toner shows an abrupt viscosity change in the range of 60° C. to 90° C. but a small viscosity change in the range of 90° C. to 120° C.

The toner that exhibits such viscosity change properties is probably present, in a binder resin contained in the toner particles, as a low-molecular-weight component and a high-molecular-weight component each in an appropriate proportion. That is, the presence of the low-molecular-weight component in the binder resin increases the likelihood of change in viscosity in the range of 60° C. to 90° C., whereas the presence of the high-molecular-weight component in the binder resin reduces the likelihood of change in viscosity in the high-temperature range of 90° C. to 120° C.

The specific toner which exhibits the viscosity change properties as described above probably shows a small change in viscosity in the range from room temperature (e.g., 20° C.) to 60° C. and has moderate viscoelasticity. That is, the presence of the specific toner in the binder resin as a low-molecular-weight component and a high-molecular-weight component in appropriate proportions reduces the likelihood of change in viscosity in the range of 60° C. or lower and also maintains the viscoelasticity in the appropriate range. Thus, the specific toner having the above-described properties is unlikely to show a change in viscosity in the range from room temperature to 60° C. and has appropriate viscoelasticity.

That is, when $(\ln \eta(T1)-\ln \eta(T2))/(T1-T2)$ is −0.14 or less, the low-molecular-weight component and the high-molecular-weight component are present each in an appropriate proportion; thus, the viscoelasticity of the toner is not excessively low, and the external additive is less likely to be buried in the toner particles if collected toner is subjected to stress. Thus, adhesion of collected toner is reduced in a collected toner transport path, and a decrease in image density may be less likely to occur when an image with a low area coverage is formed in a high-temperature and high-humidity environment. When $(\ln \eta(T2)-\ln>(T3))/(T2-T3)$ is −0.15 or more and more than $(\ln \eta(T1)-\ln \eta(T2))/(T1-T2)$, the viscoelasticity of the toner is not excessively high, and the external additive is less likely to come off the toner particles if collected toner is subjected to stress. Thus, the difference in charge between collected toner and unused toner is reduced, and unevenness in image density may be less likely to occur when an image with a low area coverage is formed in a low-temperature and low-humidity environment. That is, the specific toner is used in this exemplary embodiment, and the specific toner has appropriate viscoelasticity. Since the specific toner has these effects, a decrease in image density is less likely to occur when an image with a low area coverage is formed in a high-temperature and high-humidity environment, and unevenness in image density is less likely to occur when an image with a low area coverage is formed in a low-temperature and low-humidity environment (hereinafter also referred to simply as "a decrease in image density is less likely to occur, and unevenness in image density is also less likely to occur").

The image forming apparatus according to the exemplary embodiment executes an image forming method including a charging step of charging a surface of an image carrier, an electrostatic image forming step of forming an electrostatic image on the charged surface of the image carrier, a developing step of developing the electrostatic image formed on the surface of the image carrier with an electrostatic image developer to form a toner image, a transferring step of transferring the toner image formed on the surface of the image carrier to a surface of a recording medium, a first supply step of supplying a replenishment toner that is an electrostatic image developing toner to a developing unit, a second supply step of collecting the electrostatic image developing toner removed by cleaning the surface of the image carrier and supplying the collected toner to the developing unit, and a fixing step of fixing the toner image transferred to the surface of the recording medium.

The image forming apparatus according to the exemplary embodiment may be a known type of image forming apparatus: for example, a direct-transfer apparatus that transfers a toner image formed on a surface of an image carrier directly to a recording medium; an intermediate-transfer apparatus that first transfers a toner image formed on a surface of an image carrier to a surface of an intermediate transfer body and then transfers the toner image transferred to the surface of the intermediate transfer body to a surface of a recording medium; an apparatus including a cleaning unit that cleans a surface of an image carrier after the transfer of a toner image and before charging; or an apparatus including an erasing unit that erases charge on a surface of an image carrier by irradiation with erasing light after the transfer of a toner image and before charging.

When the image forming apparatus according to the exemplary embodiment is an intermediate-transfer apparatus, the transfer unit includes, for example, an intermediate transfer body having a surface to which a toner image is transferred, a first transfer unit that transfers a toner image formed on a surface of an image carrier to the surface of the intermediate transfer body, and a second transfer unit that transfers the toner image transferred to the surface of the intermediate transfer body to a surface of a recording medium.

In the image forming apparatus according to the exemplary embodiment, the section including the developing unit may be, for example, a cartridge structure (process cartridge) attachable to and detachable from the image forming apparatus. For example, a process cartridge including a developing unit containing the electrostatic image developer used in the image forming apparatus according to the exemplary embodiment is suitable for use as the process cartridge.

A non-limiting example of the image forming apparatus according to the exemplary embodiment will now be described. In the following description, parts illustrated in the drawings are described, and other parts are not described.

FIG. 1 is a schematic diagram illustrating the image forming apparatus according to the exemplary embodiment.

The image forming apparatus illustrated in FIG. 1 includes first to fourth electrophotographic image forming units 10Y, 10M, 10C, and 10K which respectively output yellow (Y), magenta (M), cyan (C), and black (K) images based on color-separated image data. These image forming units (hereinafter also referred to simply as "units") 10Y, 10M, 10C, and 10K are arranged side by side at predetermined intervals in the horizontal direction. The units 10Y, 10M, 10C, and 10K may be process cartridges attachable to and detachable from the image forming apparatus.

An intermediate transfer belt 20 (an example of the intermediate transfer body) extends above the units 10Y, 10M, 10C, and 10K so as to pass through the units. The intermediate transfer belt 20 is wound around a drive roller 22 and a support roller 24, which are in contact with the inner surface of the intermediate transfer belt 20, and is configured to run in the direction from the first unit 10Y toward the fourth unit 10K. A spring or the like (not shown) applies a force to the support roller 24 in the direction away from the drive roller 22, so that tension is applied to the intermediate transfer belt 20 wound around the rollers 22 and 24. An intermediate transfer belt cleaning device 30 is provided on the image carrier side of the intermediate transfer belt 20 so as to face the drive roller 22.

The units 10Y, 10M, 10C, and 10K respectively include developing devices (examples of developing units) 4Y, 4M, 4C, and 4K to which yellow, magenta, cyan, and black toners are respectively supplied from toner cartridges 8Y, 8M, 8C, and 8K.

The first to fourth units 10Y, 10M, 10C, and 10K have the same structure and function. Thus, the first unit 10Y, which is disposed upstream in the running direction of the intermediate transfer belt and forms a yellow image, will be described as a representative.

The first unit 10Y includes a photoreceptor 1Y. The photoreceptor 1Y functions as an image carrier and is surrounded by, in sequence, a charging roller 2Y (an example of the charging unit), an exposure device 3 (an example of the electrostatic image forming unit), a developing device 4Y (an example of the developing unit), a first transfer roller 5Y (an example of the first transfer unit), and a photoreceptor cleaning device 6Y (an example of the image carrier cleaning unit). The charging roller 2Y charges the surface of the photoreceptor 1Y to a predetermined potential. The exposure device 3 exposes the charged surface to a laser beam 3Y based on a color-separated image signal to form an electrostatic image. The developing device 4Y supplies a charged toner to the electrostatic image to develop the electrostatic image. The first transfer roller 5Y transfers the developed toner image to the intermediate transfer belt 20. The photoreceptor cleaning device 6Y removes the toner remaining on the surface of the photoreceptor 1Y after the first transfer.

The first transfer roller 5Y is disposed inside the intermediate transfer belt 20 so as to face the photoreceptor 1Y. The first transfer rollers 5Y, 5M, 5C, and 5K of the units are each connected to a bias power supply (not shown) that applies a first transfer bias. The value of transfer bias applied from each bias power supply to each first transfer roller is changed by control of a controller (not shown).

The operation of the first unit 10Y to form a yellow image will now be described.

Prior to the operation, the charging roller 2Y charges the surface of the photoreceptor 1Y to a potential of −600 V to −800 V.

The photoreceptor 1Y is formed of a conductive substrate (having a volume resistivity at 20° C. of, for example, $1\times10^{-6}$ Ωcm or less) and a photosensitive layer disposed on the substrate. The photosensitive layer, which normally has high resistivity (resistivity of common resins), has the property of changing its resistivity in a region irradiated with a laser beam. The exposure device 3 applies the laser beam 3Y to the charged surface of the photoreceptor 1Y on the basis of yellow image data sent from the controller (not shown). As a result, an electrostatic image with a yellow image pattern is formed on the surface of the photoreceptor 1Y.

The electrostatic image is an image formed on the surface of the photoreceptor 1Y by charging. Specifically, the electrostatic image is what is called a negative latent image formed in the following manner: in the portion of the photosensitive layer irradiated with the laser beam 3Y, the resistivity drops, and the charge on the surface of the photoreceptor 1Y dissipates from the region, while the charge remains in the portion not irradiated with the laser beam 3Y.

As the photoreceptor 1Y rotates, the electrostatic image formed on the photoreceptor 1Y is brought to a predetermined development position. At the development position, the electrostatic image on the photoreceptor 1Y is developed by the developing device 4Y to form a visible toner image.

The developing device 4Y contains, for example, an electrostatic image developer containing at least a yellow toner and a carrier. The yellow toner is frictionally charged as it is agitated inside the developing device 4Y, and thus has a charge with the same polarity (negative) as that of the charge on the photoreceptor 1Y and is held on a developer roller (an example of the developer holding body). As the surface of the photoreceptor 1Y passes through the developing device 4Y, the yellow toner is electrostatically attached to the neutralized latent image portion on the surface of the photoreceptor 1Y to develop the latent image. The photoreceptor 1Y on which the yellow toner image is formed rotates at a predetermined speed to transport the toner image developed on the photoreceptor 1Y to a predetermined first transfer position.

When the yellow toner image on the photoreceptor 1Y is transported to the first transfer position, a first transfer bias is applied to the first transfer roller 5Y, and electrostatic force directed from the photoreceptor 1Y toward the first transfer roller 5Y acts on the toner image to transfer the toner image on the photoreceptor 1Y to the intermediate transfer belt 20. The transfer bias applied has the opposite polarity (positive) to the toner (negative). In the first unit 10Y, the transfer bias is controlled to, for example, +10 μA by the controller (not shown). The toner remaining on the photoreceptor 1Y is removed and collected by the photoreceptor cleaning device 6Y.

The first transfer biases applied to the first transfer rollers 5M, 5C, and 5K of the second to fourth units 10M, 10C, and 10K are controlled in the same manner as in the first unit.

Thus, the intermediate transfer belt 20 to which the yellow toner image is transferred by the first unit 10Y is sequentially transported through the second to fourth units 10M, 10C, and 10K, and as a result, toner images of the respective colors are transferred in a superimposed manner.

The intermediate transfer belt 20, to which the toner images of the four colors are transferred in a superimposed manner through the first to fourth units, runs to a second transfer section including the intermediate transfer belt 20, the support roller 24 in contact with the inner surface of the intermediate transfer belt, and a second transfer roller 26 (an example of the second transfer unit) disposed on the image carrier side of the intermediate transfer belt 20. A sheet of recording paper P (an example of the recording medium) is fed into the nip between the second transfer roller 26 and the intermediate transfer belt 20 at a predetermined timing by a feed mechanism, and a second transfer bias is applied to the support roller 24. The transfer bias applied has the same polarity (negative) as the toner (negative), and electrostatic force directed from the intermediate transfer belt 20 toward the sheet of recording paper P acts on the toner image to transfer the toner image on the intermediate transfer belt 20 to the sheet of recording paper P. The second transfer bias is determined depending on the resistance detected by a resistance detector (not shown) that detects the resistance of the second transfer section, and thus the voltage is controlled.

The sheet of recording paper P to which the toner image is transferred is sent to a pressure-contact part (nip part) between a pair of fixing rollers of a fixing device 28 (an example of the fixing unit), and the toner image is fixed to the sheet of recording paper P, thus forming a fixed image. The sheet of recording paper P after completion of the fixing of the color image is conveyed to a discharge unit. Thus, the color image forming operation is complete.

Examples of recording paper P to which toner images are transferred include plain paper for use in electrophotographic duplicators, printers, and other devices. Examples of recording media other than the recording paper P include OHP sheets. To further improve the surface smoothness of the fixed image, the surface of the recording paper P may also be smooth. For example, coated paper, i.e., plain paper coated with resin or the like and art paper for printing are suitable for use.

Figure 3:
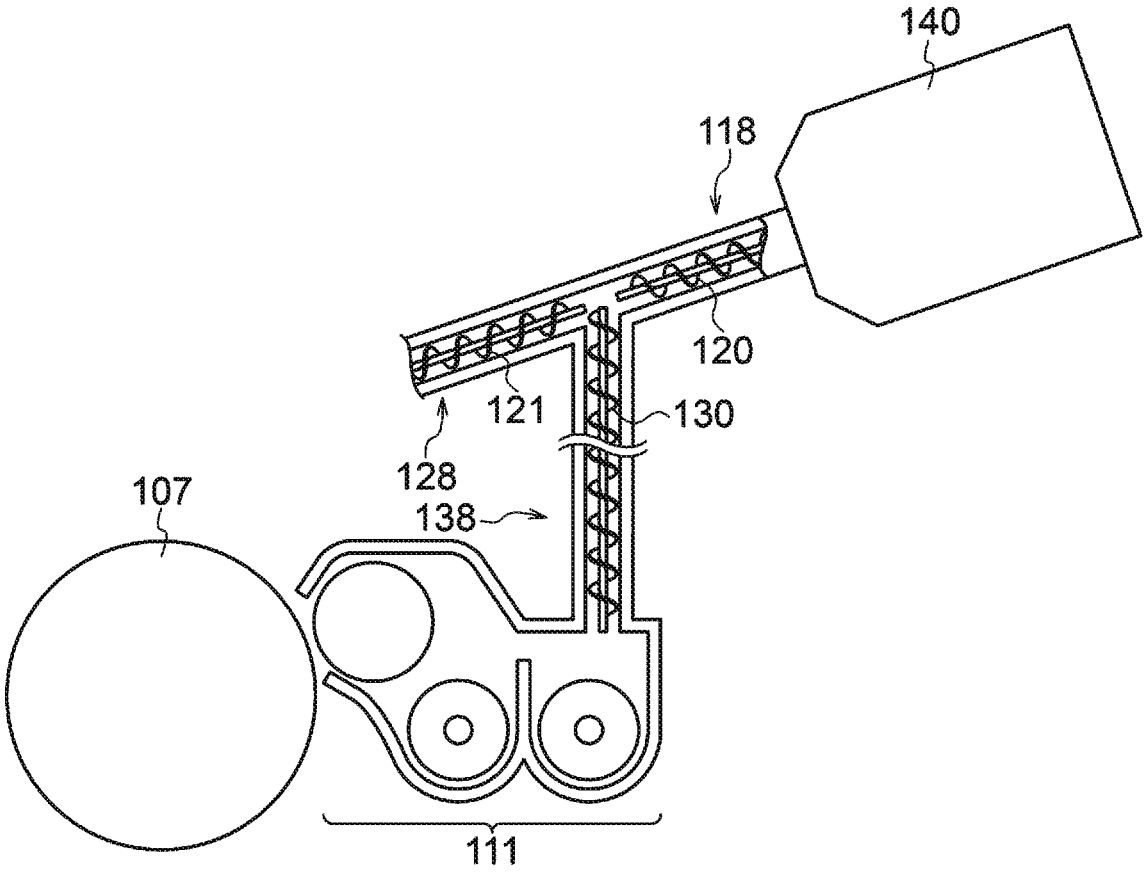
FIG. 3 is a schematic diagram illustrating examples of an image carrier, a developing unit, a first supply unit, and a second supply unit of the image forming apparatus according to the exemplary embodiment.

FIG. 3 is a schematic diagram illustrating examples of the image carrier, the developing unit, the first supply unit, and the second supply unit of the image forming apparatus according to the exemplary embodiment.

An exemplary configuration illustrated in FIG. 3 includes a photoreceptor 107, which is an example of the image carrier, and a developing device 111, which is an example of the developing unit. The exemplary configuration further includes a toner cartridge 140, which is an example of a replenishment toner container that contains replenishment toner (i.e., unused toner), a replenishment toner transport path 118, and a collected toner transport path 128. The toner cartridge 140 and the replenishment toner transport path 118 together serve as a first supply unit, and the collected toner transport path 128 serves as a second supply unit. The first supply unit and the second supply unit have a junction where the replenishment toner transport path 118 and the collected toner transport path 128 are connected together and where replenishment toner and collected toner join together. The replenishment toner and the collected toner are supplied through the junction to a toner transport path 138 and transported to the developing device 111. In the exemplary configuration illustrated in FIG. 3, the first supply unit and the second supply unit are disposed so as to be inclined relative to the horizontal plane such that the replenishment toner transport path 118 of the first supply unit is located above the collected toner transport path 128 of the second supply unit. A replenishment toner transporting auger screw 120, a collected toner transporting auger screw 121, and a toner (replenishment toner and collected toner that have joined together) transporting auger screw 130, which are examples of toner transporting members, are disposed inside the replenishment toner transport path 118, the collected toner transport path 128, and the toner transport path 138, respectively.

Figure 2:
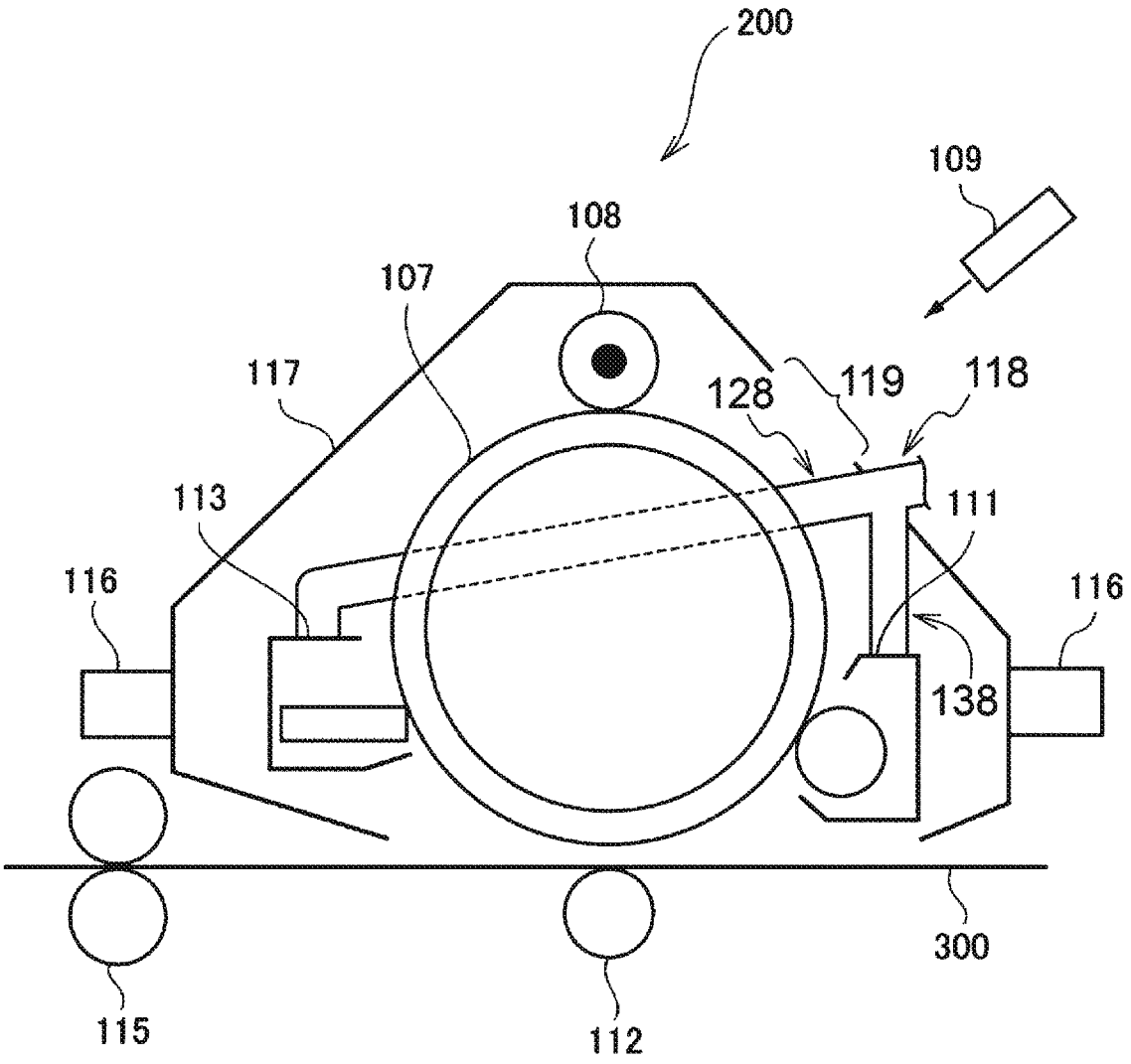
FIG. 2 is a schematic diagram illustrating an example of a process cartridge according to an exemplary embodiment.

In the exemplary configuration illustrated in FIG. 3, collected toner removed with a cleaning blade of a cleaning device 113 as illustrated in FIG. 2 is mixed with replenishment toner transported from the toner cartridge 140 and reused to contribute to development.

The configuration of the first supply unit and the second supply unit is not limited to the exemplary configuration illustrated in FIG. 3. For example, the replenishment toner transporting auger screw 120 disposed inside the replenishment toner transport path 118 and the collected toner transporting auger screw 121 disposed inside the collected toner transport path 128 may be provided as a single shaft so that replenishment toner and collected toner join together. For example, the replenishment toner transporting auger screw 120 and the collected toner transporting auger screw 121 may be provided as a single shaft such that the direction of turning of a helical blade for transporting replenishment toner on the replenishment toner transporting auger screw 120 side and the direction of turning of a helical blade for transporting collected toner on the collected toner transporting auger screw 121 side are opposite to each other. Such a configuration in which the replenishment toner transporting auger screw 120 and the collected toner transporting auger screw 121 are provided as a single shaft is useful in terms of simplification. Alternatively, the first supply unit and the second supply unit may be disposed so as to be inclined relative to the horizontal plane such that the collected toner transport path 128 of the second supply unit is located above the replenishment toner transport path 118 of the first supply unit, or the first supply unit and the second supply unit may be disposed such that the collected toner transport path 128 of the second supply unit and the replenishment toner transport path 118 of the first supply unit are close to horizontal. For smaller image forming apparatuses, the first supply unit and the second supply unit may be disposed so as to be inclined relative to the horizontal plane such that the replenishment toner transport path 118 of the first supply unit is located above the collected toner transport path 128 of the second supply unit. When the first supply unit and the second supply unit are disposed so as to be inclined relative to the horizontal plane such that the replenishment toner transport path 118 is located above the collected toner transport path 128, or disposed so as to be inclined relative to the horizontal plane such that the collected toner transport path 128 is located above the replenishment toner transport path 118, an auger screw may be provided inside each transport path. An auger screw may be provided only inside the lower-side transport path disposed so as to be inclined relative to the horizontal plane. In the transport path not provided with an auger screw, the toner may be transported by means of free fall or air transport.

Process Cartridge and Toner Cartridge

A process cartridge according to an exemplary embodiment includes a developing unit that contains the electrostatic image developer according to the exemplary embodiment and that develops an electrostatic image formed on a surface of an image carrier with the electrostatic image developer to form a toner image. The process cartridge is attachable to and detachable from an image forming apparatus.

The process cartridge according to the exemplary embodiment may include the developing unit and optionally at least one other unit selected from an image carrier, a charging unit, an electrostatic image forming unit, and a transfer unit.

A non-limiting example of the process cartridge according to the exemplary embodiment will now be described. In the following description, parts illustrated in the drawings are described, and other parts are not described.

FIG. 2 is a schematic diagram illustrating an example of the process cartridge according to the exemplary embodiment.

A process cartridge 200 illustrated in FIG. 2 includes, for example, a photoreceptor 107 (an example of the image carrier), a charging roller 108 (an example of the charging unit) disposed on the periphery of the photoreceptor 107, a developing device 111 (an example of the developing unit), a photoreceptor cleaning device 113 (an example of the cleaning unit), the collected toner transport path 128, and the replenishment toner transport path 118 which are assembled into a cartridge with a housing 117 having mounting rails 116 and an opening 119 for exposure.

In FIG. 2, 109 represents an exposure device (an example of the electrostatic image forming unit), 112 represents a transfer device (an example of the transfer unit), 115 represents a fixing device (an example of the fixing unit), and 300 represents a sheet of recording paper (an example of the recording medium). The process cartridge 200 in FIG. 2 integrally supports these devices.

The collected toner transport path 128 illustrated in FIG. 2 is connected at one end thereof to the cleaning device 113 and at the other end thereof to the replenishment toner transport path 118. The connection between the collected toner transport path 128 and the replenishment toner transport path 118 is a junction where collected toner and replenishment toner join together. The toner transport path 138, which transports joined collected toner and replenishment toner, is connected at one end thereof to the connection between the collected toner transport path 128 and the replenishment toner transport path 118 and at the other end thereof to the developing device 111. Collected toner is mixed with replenishment toner, and the mixed toner is supplied to the developing device 111 and reused to contribute to development.

Next, a toner cartridge according to an exemplary embodiment will be described.

The toner cartridge according to the exemplary embodiment contains the toner according to the exemplary embodiment and is attachable to and detachable from an image forming apparatus. The toner cartridge contains replenishment toner to be supplied to a developing unit provided in the image forming apparatus.

The image forming apparatus illustrated in FIG. 1 is configured such that the toner cartridges 8Y, 8M, 8C, and 8K are attachable thereto and detachable therefrom. The developing devices 4Y, 4M, 4C, and 4K are connected to the toner cartridges corresponding to the colors of the developing devices through toner supply tubes (not shown). The toner cartridges are replaced when the amount of toner therein is decreased.

Electrostatic Image Developer

Next, the electrostatic image developer contained in the developing unit of the image forming apparatus according to the exemplary embodiment will be described.

The electrostatic image developer in the exemplary embodiment at least contains the specific toner. The electrostatic image developer may be a one-component developer containing the specific toner alone or two-component developer containing the specific toner and a carrier.

Electrostatic Image Developing Toner

The specific toner contains toner particles and an external additive.

Characteristic Values of Temperature and Viscosity of Toner

The specific toner satisfies the following:

$(\ln \eta(T1)-\ln \eta(T2))/(T1-T2) \leq -0.14$, $(\ln \eta(T2)-\ln \eta(T3))/(T2-T3) \geq -0.15$, and $(\ln \eta(T2)-\ln \eta(T3))/(T2-T3) > (\ln \eta(T1)-\ln \eta(T2))/(T1-T2)$, wherein $\eta(T1)$ is a viscosity $\eta$ of the toner at temperature T1=60° C., $\eta(T2)$ is a viscosity $\eta$ of the toner at temperature T2=90° C., and $\eta(T3)$ is a viscosity $\eta$ of the toner at temperature T3=130° C.

In the present disclosure, "$\ln \eta(T1)$" is the natural logarithm of the viscosity $\eta$ of the toner at temperature T1=60° C.

In the present disclosure, the unit of the viscosity of the toner is Pa·s, unless otherwise specified.

In the exemplary embodiments, the viscosity of the toner at each temperature is a value determined by the following method.

The viscosity of the toner in the exemplary embodiments is determined by performing a temperature rise measurement at a frequency of 1 Hz, a strain of 20% or less, a heating rate of 1° C./min from about 30° C. to 150° C., and a sample weight of about 0.3 g using a rotational plate rheometer (RDA2, RHIOS system ver. 4.3, manufactured by Rheometrics, Inc.) with parallel plates 8 mm in diameter.

$(\ln \eta(T1)-\ln \eta(T2))/(T1-T2)$, which is a characteristic value of the specific toner, is −0.14 or less. To reduce the occurrence of a decrease in image density and also reduce the occurrence of unevenness in image density, this value is preferably −0.16 or less, more preferably −0.30 or more and −0.18 or less, particularly preferably −0.25 or more and −0.20 or less.

$(\ln \eta(T2)-\ln \eta(T3))/(T2-T3)$, which is also a characteristic value of the specific toner, is −0.15 or more. To reduce the occurrence of a decrease in image density and also reduce the occurrence of unevenness in image density, this value is preferably more than −0.14, more preferably −0.13 or more, still more preferably −0.12 or more and −0.03 or less, particularly preferably −0.11 or more and −0.05 or less.

Furthermore, the specific toner satisfies $(\ln \eta(T2)-\ln \eta(T3))/(T2-T3) > (\ln \eta(T1)-\ln \eta(T2))/(T1-T2)$. To reduce the occurrence of a decrease in image density and also reduce the occurrence of unevenness in image density, $\{(\ln \eta(T2)-\ln \eta(T3))/(T2-T3)\}-\{(\ln \eta(T1)-\ln \eta(T2))/(T1-T2)\}$ is preferably 0.01 or more, more preferably 0.05 or more and 0.5 or less, particularly preferably 0.08 or more and 0.2 or less.

Furthermore, the specific toner preferably satisfies the following:

$(\ln \eta(T0)-\ln \eta(T1))/(T0-T1) \geq -0.12$, and $(\ln \eta(T0)-\ln \eta(T1))/(T0-T1) > (\ln \eta(T1)-\ln \eta(T2))/(T1-T2)$, wherein $\eta(T0)$ is a viscosity $\eta$ of the toner at temperature T0=40° C.

When the specific toner satisfies $(\ln \eta(T0)-\ln \eta(T1))/(T0-T1) \geq -0.12$, the occurrence of a decrease in image density may be reduced, and at the same time, the occurrence of unevenness in image density tends to be reduced. $(\ln \eta(T0)-\ln \eta(T1))/(T0-T1)$ is more preferably −0.05 or less, particularly preferably −0.11 or more and −0.06 or less.

When the specific toner satisfies $(\ln \eta(T0)-\ln \eta(T1))/(T0-T1) > (\ln \eta(T1)-\ln \eta(T2))/(T1-T2)$, the occurrence of a decrease in image density may be reduced, and at the same time, the occurrence of unevenness in image density tends to be reduced. $\{(\ln \eta(T0)-\ln \eta(T1))/(T0-T1)\}-\{(\ln \eta(T1)-\ln \eta(T2))/(T1-T2)\}$ is preferably 0.01 or more, more preferably 0.05 or more and 0.5 or less, particularly preferably 0.08 or more and 0.2 or less.

These characteristic values of temperature and viscosity of the toner, that is, the characteristic values related to $(\ln \eta(T1)-\ln \eta(T2))/(T1-T2)$, $(\ln \eta(T2)-\ln \eta(T3))/(T2-T3)$, and $(\ln \eta(T0)-\ln \eta(T1))/(T0-T1)$ described above can be controlled to be in the above ranges by any method, for example, by adjusting the molecular weight in the binder resin contained in the toner particles, more specifically, by adjusting the molecular weight and content of a low molecular weight component and a high molecular weight component. In the case where the toner particles are produced by aggregation and coalescence described below, the degree of aggregation may be adjusted, for example, by adjusting the amount of aggregating agent added.

To reduce the occurrence of a decrease in image density and also reduce the occurrence of unevenness in image density, the specific toner may have a viscosity η(T0) at temperature T0=40° C., a viscosity η(T1) at temperature T1=60° C., a viscosity η(T2) at temperature T2=90° C., and a viscosity η(T3) at temperature T3=130° C. in the following ranges.

η(T0): $1.0\times10^7$ or more and $1.0\times10^9$ or less (more preferably $2.0\times10^7$ or more and $5.0\times10^8$ or less)

η(T1): $1.0\times10^5$ or more and $1.0\times10^8$ or less (more preferably $1.0\times10^6$ or more and $5.0\times10^7$ or less)

η(T2): $1.0\times10^3$ or more and $1.0\times10^5$ or less (more preferably $5.0\times10^3$ or more and $5.0\times10^4$ or less)

η(T3): $1.0\times10^2$ or more and $1.0\times10^4$ or less (more preferably $1.0\times10^2$ or more and $5.0\times10^2$ or less) Maximum endothermic peak temperature of toner The maximum endothermic peak temperature of the specific toner is preferably 70° C. or higher and 100° C. or lower, more preferably 75° C. or higher and 95° C. or lower, particularly preferably 83° C. or higher and 93° C. or lower.

The maximum endothermic peak temperature of the specific toner is a temperature that gives a maximum endothermic peak in an endothermic curve including at least the range of from −30° C. to 150° C. obtained by differential scanning calorimetry.

A method for measuring the maximum endothermic peak temperature of the specific toner will be described below.

The method uses a DSC-7 differential scanning calorimeter manufactured by PerkinElmer Inc. Temperature correction of a detector of the device is performed using the melting points of indium and zinc, and correction of heat quantity is performed using the heat of fusion of indium. An aluminum pan is used as a sample pan, and an empty pan is set as a reference. The temperature is increased from room temperature to 150° C. at a heating rate of 10° C./min, decreased from 150° C. to −30° C. at a rate of 10° C./min, and then increased from −30° C. to 150° C. at a rate of 10° C./min. The temperature at the highest endothermic peak in the second heating process is used as the maximum endothermic peak temperature.

Infrared Absorption Spectrum of Toner Particles

When the specific toner contains an amorphous polyester resin described below as a binder resin, to reduce the occurrence of a decrease in image density and also reduce the occurrence of unevenness in image density, the ratio of an absorbance at a wave number of 1,500 $cm^{-1}$ to an absorbance at a wave number of 720 $cm^{-1}$ (absorbance at wave number of 1,500 cm/absorbance at wave number of 720 $cm^{-1}$) is preferably 0.6 or less, and the ratio of an absorbance at a wave number of 820 $cm^{-1}$ to an absorbance at a wave number of 720 $cm^{-1}$ (absorbance at wave number of 820 $cm^{-1}$/absorbance at wave number of 720 $cm^{-1}$) is preferably 0.4 or less in infrared absorption spectrum analysis of the toner particles. More preferably, the ratio of an absorbance at a wave number of 1,500 $cm^{-1}$ to an absorbance at a wave number of 720 $cm^{-1}$ is 0.4 or less, and the ratio of an absorbance at a wave number of 820 $cm^{-1}$ to an absorbance at a wave number of 720 $cm^{-1}$ is 0.2 or less in infrared absorption spectrum analysis of the toner particles. Particularly preferably, the ratio of an absorbance at a wave number of 1,500 $cm^{-1}$ to an absorbance at a wave number of 720 $cm^{-1}$ is 0.2 or more and 0.4 or less, and the ratio of an absorbance at a wave number of 820 $cm^{-1}$ to an absorbance at a wave number of 720 $cm^{-1}$ is 0.05 or more and 0.2 or less in infrared absorption spectrum analysis of the toner particles.

The measurement of the absorbance at the predetermined wave numbers by infrared absorption spectrum analysis in the exemplary embodiments is carried out by the method described below. First, a test sample is prepared from target toner particles (toner from which external additives are removed as required) by using the KBr pellet method. The test sample is then measured using an infrared spectrophotometer (FT-IR-410 manufactured by JASCO Corporation) in the wave number range of 500 $cm^{-1}$ to 4,000 $cm^{-1}$ under the following conditions: the number of scans, 300; resolution, 4 $cm^{-1}$. Baseline correction is performed, for example, in an offset region where no light is absorbed, and the absorbance at the predetermined wave numbers is determined.

To reduce the occurrence of a decrease in image density and also reduce the occurrence of unevenness in image density, the ratio of an absorbance at a wave number of 1,500 $cm^{-1}$ to an absorbance at a wave number of 720 $cm^{-1}$ in infrared absorption spectrum analysis of the toner particles in the specific toner is preferably 0.6 or less, more preferably 0.4 or less, still more preferably 0.2 or more and 0.4 or less, particularly preferably 0.3 or more and 0.4 or less.

To reduce the occurrence of a decrease in image density and also reduce the occurrence of unevenness in image density, the ratio of an absorbance at a wave number of 820 $cm^{-1}$ to an absorbance at a wave number of 720 $cm^{-1}$ in infrared absorption spectrum analysis of the toner particles in the specific toner is preferably 0.4 or less, more preferably 0.2 or less, still more preferably 0.05 or more and 0.2 or less, particularly preferably 0.08 or more and 0.2 or less.

Toner Particles

The toner particles contain, for example, a binder resin and optionally a coloring agent, a release agent, and other additives. Preferably, the toner particles contain a binder resin and a release agent.

In the exemplary embodiments, the toner particles may be, for example, but not limited to, toner particles of yellow toner, magenta toner, cyan toner, or black toner, white toner particles, transparent toner particles, or photoluminescent toner particles.

Binder Resin

Examples of binder resins include vinyl resins made of homopolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene); and vinyl resins made of copolymers of two or more of these monomers.

Other examples of binder resins include non-vinyl resins such as epoxy resins, polyester resins, polyurethane resins, polyamide resins, cellulose resins, polyether resins, and modified rosins; mixtures of these non-vinyl resins and the above vinyl resins; and graft polymers obtained by polymerization of vinyl monomers in the presence of these non-vinyl resins.

These binder resins may be used alone or in combination.

To reduce the occurrence of a decrease in image density and also reduce the occurrence of unevenness in image density, the binder resin preferably contains at least one selected from the group consisting of styrene-acrylic resins and amorphous polyester resins, more preferably contains a styrene-acrylic resin or an amorphous polyester resin. Still more preferably, the styrene-acrylic resin or amorphous polyester resin is contained in an amount of 50 mass % or more based on the total mass of the binder resin contained in the toner. Particularly preferably, the styrene-acrylic resin or amorphous polyester resin is contained in an amount of 80 mass % or more based on the total mass of the binder resin contained in the toner.

In view of the strength and storage stability of the toner, the specific toner may contain a styrene-acrylic resin as the binder resin.

In view of low-temperature fixability, the specific toner may contain an amorphous polyester resin as the binder resin.

To reduce the occurrence of a decrease in image density and also reduce the occurrence of unevenness in image density, and in view of fixability, the amorphous polyester resin may be an amorphous polyester resin having no bisphenol structures.

(1) Styrene-Acrylic Resin

The binder resin may be a styrene-acrylic resin.

The styrene-acrylic resin is a copolymer of at least a styrene monomer (a monomer having a styrene skeleton) and a (meth)acrylic monomer (a monomer having a (meth) acrylic group, preferably a monomer having a (meth)acryloxy group). The styrene-acrylic resin contains, for example, a copolymer of a monomer of a styrene and a monomer of any one of the above (meth)acrylates.

The acrylic resin moiety in the styrene-acrylic resin is a substructure formed by polymerization of one or both of an acrylic monomer and a methacrylic monomer. The expression "(meth)acrylic" is meant to include both "acrylic" and "methacrylic".

Specific examples of styrene monomers include styrene, alkyl-substituted styrenes (e.g., α-methylstyrene, 2-methylstyrene, 3-methylstyrene, 4-methylstyrene, 2-ethylstyrene, 3-ethylstyrene, and 4-ethylstyrene), halogen-substituted styrenes (e.g., 2-chlorostyrene, 3-chlorostyrene, and 4-chlorostyrene), and vinylnaphthalene. These styrene monomers may be used alone or in combination.

Of these styrene monomers, styrene is preferred for its ease of reaction, ease of reaction control, and availability.

Specific examples of (meth)acrylic monomers include (meth)acrylic acid and (meth)acrylates. Examples of (meth) acrylates include alkyl (meth)acrylates (e.g., methyl (meth) acrylate, ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth) acrylate, cyclohexyl (meth)acrylate, and t-butylcyclohexyl (meth)acrylate), aryl (meth)acrylates (e.g., phenyl (meth) acrylate, biphenyl (meth)acrylate, diphenylethyl (meth) acrylate, t-butylphenyl (meth)acrylate, and terphenyl (meth) acrylate), dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, and (meth)acrylamides. These (meth)acrylate monomers may be used alone or in combination.

Of these (meth)acrylates among the (meth)acrylic monomers, (meth)acrylates having an alkyl group having 2 to 14 (preferably 2 to 10, more preferably 3 to 8) carbon atoms are preferred in terms of fixability.

In particular, n-butyl (meth)acrylate is preferred, and n-butyl acrylate is particularly preferred.

The copolymerization ratio (by mass) of the styrene monomer to the (meth)acrylic monomer (styrene monomer/(meth)acrylic monomer) is preferably, but not necessarily, 85/15 to 70/30.

To reduce the occurrence of a decrease in image density and also reduce the occurrence of unevenness in image density, the styrene-acrylic resin may have a crosslinked structure. The styrene-acrylic resin having a crosslinked structure may be, for example, a copolymer of at least a styrene monomer, a (meth)acrylate monomer, and a crosslinkable monomer.

Examples of crosslinkable monomers include bi- or more functional cross-linking agents.

Examples of bifunctional cross-linking agents include divinylbenzene, divinylnaphthalene, di(meth)acrylate compounds (e.g., diethylene glycol di(meth)acrylate, methylenebis(meth)acrylamide, decanediol diacrylate, and glycidyl (meth)acrylate), polyester di(meth)acrylates, and 2-([1'-methylpropylideneamino]carboxyamino) ethyl (meth)acrylate.

Examples of polyfunctional crosslinking agents include tri(meth)acrylate compounds (e.g., pentaerythritol tri(meth) acrylate, trimethylolethane tri(meth)acrylate, and trimethylolpropane tri(meth)acrylate), tetra(meth)acrylate compounds (e.g., pentaerythritol tetra(meth)acrylate and oligoester (meth)acrylates), 2,2-bis(4-methacryloxypolyethoxyphenyl) propane, diallyl phthalate, triallyl cyanurate, triallyl isocyanurate, triallyl trimellitate, and diallyl chlorendate.

To reduce the occurrence of a decrease in image density and also reduce the occurrence of unevenness in image density, and in view of fixability, the crosslinkable monomer is preferably a bi- or more functional (meth)acrylate compound, more preferably a bifunctional (meth)acrylate compound, still more preferably a bifunctional (meth)acrylate compound having an alkylene group having 6 to 20 carbon atoms, particularly preferably a bifunctional (meth)acrylate compound having a linear alkylene group having 6 to 20 carbon atoms.

The copolymerization ratio (by mass) of the crosslinkable monomer to all monomers (crosslinkable monomer/all monomers) is preferably, but not necessarily, 2/1,000 to 20/1,000.

In view of fixability, the glass transition temperature (Tg) of the styrene-acrylic resin is preferably 40° C. or higher and 75° C. or lower, more preferably 50° C. or higher and 65° C. or lower.

The glass transition temperature is determined from a DSC curve obtained by differential scanning calorimetry (DSC). More specifically, the glass transition temperature is determined in accordance with "Extrapolation Glass Transition Onset Temperature" described in Determination of Glass Transition Temperature in JIS K 7121-1987 "Testing Methods for Transition Temperatures of Plastics".

In view of storage stability, the weight average molecular weight of the styrene-acrylic resin is preferably 5,000 or more and 200,000 or less, more preferably 10,000 or more and 100,000 or less, particularly preferably 20,000 or more and 80,000 or less.

The styrene-acrylic resin may be produced by any method, and various polymerization methods (e.g., solution polymerization, precipitation polymerization, suspension polymerization, bulk polymerization, and emulsion polymerization) may be used. The polymerization reaction is carried out by using a known process (e.g., a batch process, a semi-continuous process, or a continuous process).

(2) Polyester Resin

The binder resin may be a polyester resin.

Examples of polyester resins include known amorphous polyester resins. The polyester resin may be a combination of an amorphous polyester resin with a crystalline polyester resin. The crystalline polyester resin may be present in an amount of 2 mass % or more and 40 mass % or less (preferably 2 mass % or more and 20 mass % or less) based on the total mass of the binder resin.

"Crystalline" in the context of a resin means that the resin shows a distinct endothermic peak, rather than a stepwise change in the amount of heat absorbed, in differential scanning calorimetry (DSC). Specifically, it means that the half-width of the endothermic peak measured at a heating rate of 10° C./min is within 10° C.

"Amorphous" in the context of a resin means that the half-width exceeds 10° C., that a stepwise change in the amount of heat absorbed is shown, or that no distinct endothermic peak is observed.

Amorphous Polyester Resin

Examples of amorphous polyester resins include polycondensates of polycarboxylic acids with polyhydric alcohols. The amorphous polyester resin for use may be a commercially available product or may be synthesized.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, and lower (e.g., C1 to C5) alkyl esters thereof. Of these, aromatic dicarboxylic acids are preferred, for example.

The polycarboxylic acid may be a combination of a dicarboxylic acid with a trivalent or higher valent carboxylic acid having a crosslinked or branched structure. Examples of trivalent or higher valent carboxylic acids include trimellitic acid, pyromellitic acid, anhydrides thereof, and lower (e.g., C1 to C5) alkyl esters thereof.

These polycarboxylic acids may be used alone or in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Of these, aromatic diols and alicyclic diols are preferred, and aromatic diols are more preferred.

The polyhydric alcohol may be a combination of a diol with a trivalent or higher valent polyhydric alcohol having a crosslinked or branched structure. Examples of trivalent or higher valent polyhydric alcohols include glycerol, trimethylolpropane, and pentaerythritol.

These polyhydric alcohols may be used alone or in combination.

The glass transition temperature (Tg) of the amorphous polyester resin is preferably 50° C. or higher and 80° C. or lower, more preferably 50° C. or higher and 65° C. or lower.

The glass transition temperature is determined from a DSC curve obtained by differential scanning calorimetry (DSC). More specifically, the glass transition temperature is determined in accordance with "Extrapolation Glass Transition Onset Temperature" described in Determination of Glass Transition Temperature in JIS K 7121-1987 "Testing Methods for Transition Temperatures of Plastics".

The weight average molecular weight (Mw) of the amorphous polyester resin is preferably 5,000 or more and 1,000,000 or less, more preferably 7,000 or more and 500,000 or less.

The number average molecular weight (Mn) of the amorphous polyester resin is preferably 2,000 or more and 100,000 or less.

The molecular weight distribution Mw/Mn of the amorphous polyester resin is preferably 1.5 or more and 100 or less, more preferably 2 or more and 60 or less.

The weight average molecular weight and the number average molecular weight are determined by gel permeation chromatography (GPC). The molecular weight determination by GPC is performed using an HLC-8120GPC system manufactured by Tosoh Corporation as a measurement apparatus, a TSKgel SuperHM-M column (15 cm) manufactured by Tosoh Corporation, and a THF solvent. The weight average molecular weight and the number average molecular weight are determined using a molecular weight calibration curve prepared from the measurement results relative to monodisperse polystyrene standards.

The amorphous polyester resin may be produced by a known process. Specifically, the amorphous resin may be produced, for example, by performing a polymerization reaction at a temperature of 180° C. to 230° C., optionally while removing water and alcohol produced during condensation by reducing the pressure in the reaction system.

If any starting monomer is insoluble or incompatible at the reaction temperature, it may be dissolved by adding a high-boiling solvent as a solubilizer. In this case, the polycondensation reaction is performed while distilling off the solubilizer. If the copolymerization reaction is performed using a poorly compatible monomer, the poorly compatible monomer may be condensed with an acid or alcohol to be polycondensed with the monomer before being polycondensed with the major components.

Crystalline Polyester Resin

Examples of crystalline polyester resins include polycondensates of polycarboxylic acids with polyhydric alcohols. The crystalline polyester resin for use may be a commercially available product or may be synthesized.

To easily form a crystalline structure, the crystalline polyester resin may be a polycondensate prepared from linear aliphatic polymerizable monomers rather than from aromatic polymerizable monomers.

Examples of polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, and naphthalene-2,6-dicarboxylic acid), anhydrides thereof, and lower (e.g., C1 to C5) alkyl esters thereof.

The polycarboxylic acid may be a combination of a dicarboxylic acid with a trivalent or higher valent carboxylic acid having a cross-linked or branched structure. Examples of tricarboxylic acids include aromatic carboxylic acids (e.g., 1,2,3-benzenetricarboxylic acid, 1,2,4-benzenetricarboxylic acid, and 1,2,4-naphthalenetricarboxylic acid), anhydrides thereof, and lower (e.g., C1 to C5) alkyl esters thereof.

The polycarboxylic acid may be a combination of such a dicarboxylic acid with a dicarboxylic acid having a sulfonic group or a dicarboxylic acid having an ethylenic double bond.

These polycarboxylic acids may be used alone or in combination.

Examples of polyhydric alcohols include aliphatic diols (e.g., linear aliphatic diols having 7 to 20 main-chain carbon atoms). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these, 1,8-octanediol, 1,9-nonanediol, and 1,10-decanediol are preferred.

The polyhydric alcohol may be a combination of a diol with a trivalent or higher valent alcohol having a cross-linked or branched structure. Examples of trivalent or higher valent alcohols include glycerol, trimethylolethane, trimethylolpropane, and pentaerythritol.

These polyhydric alcohols may be used alone or in combination.

The amount of aliphatic diol in the polyhydric alcohol may be 80 mol % or more and is preferably 90 mol % or more.

The melting temperature of the crystalline polyester resin is preferably 50° C. or higher and 100° C. or lower, more preferably 55° C. or higher and 90° C. or lower, still more preferably 60° C. or higher and 85° C. or lower.

The melting temperature is determined from a DSC curve obtained by differential scanning calorimetry (DSC) in accordance with "Melting Peak Temperature" described in Determination of Melting Temperature of JIS K 7121-1987 "Testing Methods for Transition Temperatures of Plastics".

The weight-average molecular weight (Mw) of the crystalline polyester resin is preferably 6,000 or more and 35,000 or less.

The crystalline polyester resin may be produced, for example, by a known method, as with the amorphous polyester resin.

For example, the amount of binder resin is preferably 40 mass % or more and 95 mass % or less, more preferably 50 mass % or more and 90 mass % or less, still more preferably 60 mass % or more and 85 mass % or less, based on the total mass of the toner particles.

The amount of binder resin in the case where the toner particles are white toner particles is preferably 30 mass % or more and 85 mass % or less, more preferably 40 mass % or more and 60 mass % or less, based on the total mass of the white toner particles.

Coloring Agent

Examples of coloring agents include various pigments such as carbon black, chromium yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, malachite green oxalate, titanium oxide, zinc oxide, calcium carbonate, basic lead carbonate, zinc sulfide-barium sulfate mixtures, zinc sulfide, silicon dioxide, and aluminum oxide; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

When the toner particles are white toner particles, a white pigment is used as a coloring agent.

The white pigment is preferably titanium oxide or zinc oxide, more preferably titanium oxide.

The above coloring agents may be used alone or in combination.

Optionally, the coloring agent may be a surface-treated coloring agent or may be used in combination with a dispersant. The coloring agent may be a combination of different coloring agents.

For example, the amount of coloring agent is preferably 1 mass % or more and 30 mass % or less, more preferably 3 mass % or more and 15 mass % or less, based on the total mass of the toner particles.

When the toner particles are white toner particles, the amount of white pigment is preferably 15 mass % or more and 70 mass % or less, more preferably 20 mass % or more and 60 mass % or less, based on the total mass of the white toner particles.

Release Agent

Examples of release agents include hydrocarbon waxes; natural waxes such as carnauba wax, rice wax, and Candelilla wax; synthetic, mineral, and petroleum waxes such as montan wax; and ester waxes such as fatty acid esters and montanic acid esters, but are not limited thereto.

To reduce the occurrence of a decrease in image density and also reduce the occurrence of unevenness in image density, the melting temperature of the release agent is preferably 50° C. or higher and 110° C. or lower, more preferably 70° C. or higher and 100° C. or lower, still more preferably 75° C. or higher and 95° C. or lower, particularly preferably 83° C. or higher and 93° C. or lower.

The melting temperature is determined from a DSC curve obtained by differential scanning calorimetry (DSC) in accordance with "Melting Peak Temperature" described in Determination of Melting Temperature of JIS K 7121-1987 "Testing Methods for Transition Temperatures of Plastics".

To reduce the occurrence of a decrease in image density and also reduce the occurrence of unevenness in image density, the toner particles in the specific toner preferably satisfy $1.0<a/b<8.0$, more preferably satisfy $2.0<a/b<7.0$, particularly preferably satisfy $3.0<a/b<6.0$, wherein a is the number of domains formed of the release agent and having an aspect ratio of 5 or more in the toner particles, and b is the number of domains formed of the release agent and having an aspect ratio of less than 5 in the toner.

To reduce the occurrence of a decrease in image density and also reduce the occurrence of unevenness in image density, the toner particles in the specific toner preferably satisfy $1.0<c/d<4.0$, more preferably satisfy $1.5<c/d<3.5$, particularly preferably satisfy $2.0<c/d<3.0$, wherein c is the area of domains formed of the release agent and having an aspect ratio of 5 or more in the toner particles, and d is the area of domains formed of the release agent and having an aspect ratio of less than 5 in the toner.

The aspect ratio of domains formed of the release agent in the toner particles is determined by the following method.

The toner is mixed with epoxy resin, and the epoxy resin is cured. The resulting cured resin is sliced with an ultramicrotome (ULTRACUT UCT manufactured by Leica Microsystems) to prepare a sample section having a thickness of 80 nm or more and 130 nm or less. Next, the sample section is stained with ruthenium tetroxide in a desiccator at 30° C. for 3 hours. An SEM image of the stained sample section is captured under a super-resolution field-emission scanning electron microscope (FE-SEM) (e.g., S-4800 manufactured by Hitachi High-Technologies Corporation). In general, release agents are more easily stained with ruthenium tetroxide than binder resins, and thus the release agent is distinguished by the density depending on the degree of staining. If the density is difficult to determine, for example, because of the sample condition, the staining time is adjusted. The release agent is distinguishable by its size because coloring agent domains are generally smaller than release agent domains in a toner particle section.

The SEM image includes toner particle sections with various sizes. Toner particle sections having a diameter larger than or equal to 85% of the volume average particle size of the toner particles are selected. From these sections, 100 toner particle sections are randomly selected and observed. The diameter of a toner particle section is a maximum length (i.e., a major axis) between any two points on the contour of the toner particle section.

Each of the 100 toner particle sections selected as described above in the SEM image is subjected to image analysis using image analysis software (WINROOF available from Mitani Corporation) under the condition of 0.010000 μm/pixel. This image analysis allows the images of the toner particle sections to be observed based on the difference in brightness (contrast) between the epoxy resin used for embedding and the binder resin in the toner particles. The length along the major axis, the ratio (length along major axis/length along minor axis), and the area of release agent domains in the toner particles can be determined based on the observed image.

The aspect ratio of domains formed of the release agent in the toner particles can be controlled, for example, by maintaining the temperature, during cooling, at around the freezing point of the release agent for a given period of time to grow crystals or by using two or more release agents having different melting temperatures to facilitate the crystal growth during cooling.

For example, the amount of release agent is preferably 1 mass % or more and 20 mass % or less, more preferably 5 mass % or more and 15 mass % or less, based on the total mass of the toner particles.

Other Additives

Examples of other additives include known additives such as magnetic materials, charge control agents, and inorganic powders. These additives are contained as internal additives in the toner particles.

Properties of Toner Particles

The toner particles may be toner particles having a single-layer structure or toner particles having, what is called, a core-shell structure composed of a core (core particle) and a coating layer (shell layer) covering the core.

The toner particles having a core-shell structure may be composed of, for example, a core and a coating layer, the core containing a binder resin and other optional additives such as a coloring agent and a release agent, the coating layer containing a binder resin.

The volume average particle size (D50v) of the toner particles is preferably 2 μm or more and 10 μm or less, more preferably 4 μm or more and 8 μm or less.

The volume average particle size of the toner particles is measured using a COULTER MULTISIZER II (manufactured by Beckman Coulter, Inc.) and ISOTON-II electrolyte solution (manufactured by Beckman Coulter, Inc.).

In the measurement, 0.5 mg to 50 mg of a test sample is added to 2 ml of a 5 mass % aqueous solution of a surfactant (e.g., sodium alkylbenzene sulfonate) serving as a dispersant. The resulting solution is added to 100 ml to 150 ml of the electrolyte solution.

The electrolyte solution containing the suspended sample is dispersed with a sonicator for 1 minute, and the particle size distribution of particles having particle sizes in the range of from 2 μm to 60 μm is measured with the COULTER MULTISIZER II using an aperture having an aperture diameter of 100 μm. The number of sampled particles is 50,000.

The particle size distribution obtained is divided into particle size classes (channels). A cumulative volume distribution is drawn from smaller particle sizes. The volume-average particle size D50v is defined as the particle size at which the cumulative volume is 50%.

The average roundness of the toner particles is not limited to a particular value but is preferably 0.91 or more and 0.98 or less, more preferably 0.94 or more and 0.98 or less, still more preferably 0.95 or more and 0.97 or less, for improved cleaning of the toner off the image carrier.

The average roundness of the toner particles is determined by (perimeter of equivalent circle)/(perimeter) [(perimeter of circle having same projected area as that of particle image)/(perimeter of projected particle image)]. Specifically, the average roundness is measured by the following method.

Target toner particles are collected by suction so as to form a flat flow, and strobe light is flashed to capture a still particle image. The particle image is analyzed with a flow particle image analyzer (FPIA-3000 manufactured by Sysmex Corporation). The number of particles sampled for determining the average roundness is 3,500.

When the toner contains an external additive, the toner (developer) to be measured is dispersed in water containing a surfactant and then sonicated to obtain toner particles from which the external additive has been removed.

For example, when the toner particles are produced by aggregation and coalescence, the average roundness of the toner particles can be controlled by adjusting the rate of stirring a dispersion, the temperature of the dispersion, or the retention time in a fusion and coalescence step.

External Additive

Examples of external additives include inorganic particles. Examples of inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of inorganic particles used as an external additive may be subjected to hydrophobic treatment. The hydrophobic treatment may be performed, for example, by immersing the inorganic particles in a hydrophobic agent. Non-limiting examples of hydrophobic agents include silane coupling agents, silicone oil, titanate coupling agents, and aluminum coupling agents. These hydrophobic agents may be used alone or in combination.

The amount of hydrophobic agent is typically, for example, 1 part by mass or more and 10 parts by mass or less based on 100 parts by mass of the inorganic particles.

Other examples of external additives include resin particles (particles of resins such as polystyrene, polymethyl methacrylate (PMMA), and melamine resins) and cleaning active agents (e.g., particles of higher fatty acid metal salts such as zinc stearate, and fluoropolymer particles).

Of these, metal oxides may be used as external additives, and at least one of titania particles and silica particles may be contained.

For example, the amount of external additive added is preferably 0.01 mass % or more and 10 mass % or less, more preferably 0.01 mass % or more and 6 mass % or less, based on the amount of toner particles.

Method for Producing Toner

Next, a method for producing the specific toner will be described.

The specific toner is obtained by producing toner particles and then adding an external additive to the toner particles.

The toner particles may be produced by a dry process (e.g., kneading pulverization) or a wet process (e.g., aggregation and coalescence, suspension polymerization, or dissolution suspension). Not only these processes but any known process may be used to produce the toner particles.

Of these, aggregation and coalescence may be used to obtain the toner particles.

Specifically, for example, when the toner particles are produced by aggregation and coalescence, they are produced by the following steps:

a step (a resin particle dispersion preparing step) of preparing a resin particle dispersion in which resin particles serving as a binder resin are dispersed; a step (an aggregate particle forming step) of aggregating the resin particles (optionally, other particles) in the resin particle dispersion (optionally, a dispersion mixture with another particle dispersion) to form aggregate particles; and a step (a fusion and coalescence step) of heating the aggregate particle dispersion, in which the aggregate particles are dispersed, to fuse and coalesce the aggregate particles, thereby forming toner particles.

The steps will be described below in detail.

Although a method for producing toner particles containing a coloring agent and a release agent will be described below, the coloring agent and the release agent are optional. It should be understood that additives other than coloring agents and release agents may also be used.

Resin Particle Dispersion Preparing Step

First, a resin particle dispersion in which resin particles serving as a binder resin are dispersed as well as, for example, a coloring agent particle dispersion in which coloring agent particles are dispersed and a release agent particle dispersion in which release agent particles are dispersed are prepared.

The resin particle dispersion is prepared, for example, by dispersing resin particles in a dispersion medium with a surfactant.

Examples of dispersion media used to prepare the resin particle dispersion include aqueous media.

Examples of aqueous media include water, such as distilled water and ion-exchanged water, and alcohols. These aqueous media may be used alone or in combination.

Examples of surfactants include anionic surfactants such as sulfate ester salts, sulfonate salts, phosphate esters, and soaps; cationic surfactants such as amine salts and quaternary ammonium salts; and nonionic surfactants such as polyethylene glycol, alkylphenol-ethylene oxide adducts, and polyhydric alcohols. Of these, anionic surfactants and cationic surfactants are particularly preferred. Nonionic surfactants may be used in combination with an anionic surfactant or a cationic surfactant.

These surfactants may be used alone or in combination.

In preparing the resin particle dispersion, the resin particles may be dispersed in a dispersion medium by any commonly-used dispersion technique, for example, a rotary shear homogenizer or a media mill such as a ball mill, a sand mill, or a Dyno-Mill. Depending on the type of resin particles, the resin particles may be dispersed in the resin particle dispersion, for example, by phase-inversion emulsification.

Phase-inversion emulsification is a process involving dissolving a resin of interest in a hydrophobic organic solvent capable of dissolving the resin, neutralizing the organic continuous phase (O-phase) by adding a base thereto, and then adding an aqueous medium (W-phase) to cause inversion (i.e., phase inversion) of the resin from W/O to O/W and form a discontinuous phase, thereby dispersing the resin in the form of particles in the aqueous medium.

The volume average particle size of the resin particles dispersed in the resin particle dispersion is, for example, preferably 0.01 μm or more and 1 μm or less, more preferably 0.08 μm or more and 0.8 μm or less, still more preferably 0.1 μm or more and 0.6 μm or less.

The volume average particle size of the resin particles is determined as follows. A particle size distribution is obtained using a laser diffraction particle size distribution analyzer (e.g., LA-700 manufactured by Horiba, Ltd.) and is divided into particle size classes (channels). A cumulative volume distribution is drawn from smaller particle sizes. The volume average particle size D50v is measured as the particle size at which the cumulative volume is 50% of all particles. The volume average particle sizes of particles in other dispersions are determined in the same manner.

For example, the amount of resin particles contained in the resin particle dispersion is preferably 5 mass % or more and 50 mass % or less, more preferably 10 mass % or more and 40 mass % or less.

The coloring agent particle dispersion and the release agent particle dispersion are prepared in the same manner as the resin particle dispersion. That is, the volume average particle size of particles, the dispersion medium, the dispersion technique, and the amount of particles for the resin particle dispersion are also applied to coloring agent particles dispersed in the coloring agent particle dispersion and release agent particles dispersed in the release agent particle dispersion.

Aggregate Particle Forming Step

Next, the resin particle dispersion is mixed with the coloring agent particle dispersion and the release agent particle dispersion.

The resin particles, the coloring agent particles, and the release agent particles are then allowed to undergo hetero-aggregation in the mixed dispersion to form aggregate particles including the resin particles, the coloring agent particles, and the release agent particle. The aggregate particles have a particle size close to that of the desired toner particles.

Specifically, the aggregate particles are formed, for example, by adding an aggregating agent to the mixed dispersion while adjusting the mixed dispersion to an acidic pH (e.g., a pH of 2 to 5), optionally adding a dispersion stabilizer, and then heating the mixed dispersion to aggregate the particles dispersed therein. The mixed dispersion is heated to a temperature close to the glass transition temperature of the resin particles (e.g., 10° C. to 30° C. lower than the glass transition temperature of the resin particles).

For example, the aggregate particle forming step may be performed by adding an aggregating agent to the mixed dispersion at room temperature (e.g., 25° C.) with stirring using a rotary shear homogenizer, adjusting the mixed dispersion to an acidic pH (e.g., a pH of 2 to 5), optionally adding a dispersion stabilizer, and then heating the mixed dispersion.

Examples of aggregating agents include surfactants having polarity opposite to that of the surfactant used as a dispersant added to the mixed dispersion, inorganic metal salts, and metal complexes with a valence of two or more. In particular, the use of a metal complex as the aggregating agent may reduce the amount of surfactant used, which may improve the charging characteristics.

Additives that form a complex or a similar linkage together with metal ions of the aggregating agent may optionally be used. Examples of such additives include chelating agents.

Examples of inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of chelating agents include oxycarboxylic acids such as tartaric acid, citric acid, and gluconic acid; iminodiacetic acid (IDA); nitrilotriacetic acid (NTA); and ethylenediaminetetraacetic acid (EDTA).

For example, the amount of chelating agent added is preferably 0.01 parts by mass or more and 5.0 parts by mass or less, more preferably 0.1 parts by mass or more and less than 3.0 parts by mass, based on 100 parts by mass of the resin particles.

Fusion and Coalescence Step

Next, the aggregate particle dispersion in which the aggregate particles are dispersed is heated, for example, at or above the glass transition temperature of the resin particles (e.g., 10° C. to 30° C. higher than the glass transition temperature of the resin particles) to fuse and coalesce the aggregate particles, thereby forming toner particles.

Alternatively, the aggregate particle dispersion may be heated at or above the melting temperature of the release agent to fuse and coalesce the aggregate particles, thereby forming toner particles. In the fusion and coalescence step, the resin and the release agent are in a molten state at or above the glass transition temperature of the resin particles and at or above the melting temperature of the release agent. Thereafter, cooling is performed to obtain toner particles.

The aspect ratio of domains formed of the release agent in the toner particles can be controlled, for example, by maintaining the temperature, during cooling, at around the freezing point of the release agent for a given period of time to grow crystals or by using two or more release agents having different melting temperatures to facilitate the crystal growth during cooling.

Through the above steps, toner particles are obtained.

The toner particles may also be produced through a step of, after preparing the aggregate particle dispersion in which the aggregate particles are dispersed, further mixing the aggregate particle dispersion with a resin particle dispersion in which resin particles are dispersed and aggregating the resin particles such that the resin particles adhere to the surface of the aggregate particles to form second aggregate particles; and a step of fusing and coalescing the second aggregate particles by heating the second aggregate particle dispersion in which the second aggregate particles are dispersed to form toner particles having a core-shell structure.

After the completion of the fusion and coalescence step, the toner particles formed in the solution are subjected to known washing, solid-liquid separation, and drying steps to obtain dry toner particles.

The washing step may be performed by sufficient displacement washing with ion-exchanged water in terms of charging characteristics. Although the solid-liquid separation step may be performed by any process, processes such as suction filtration and pressure filtration may be used in terms of productivity. Although the drying step may be performed by any process, processes such as freeze drying, flash drying, fluidized bed drying, and vibrating fluidized bed drying may be used in terms of productivity.

The specific toner is produced, for example, by adding an external additive to the dry toner particles obtained and mixing them together. The mixing may be performed, for example, with a V-blender, a HENSCHEL mixer, or a Loedige mixer. Optionally, coarse toner particles may be removed using, for example, a vibrating screen or an air screen.

Carrier

The carrier may be any known carrier. Examples of carriers include coated carriers obtained by coating the surface of cores formed of magnetic powders with coating resins; magnetic-powder-dispersed carriers obtained by dispersing and blending magnetic powders in matrix resins; and resin-impregnated carriers obtained by impregnating porous magnetic powders with resins.

The magnetic-powder-dispersed carriers and the resin-impregnated carriers may also be carriers obtained by using the constituent particles of the carriers as cores and coating the cores with coating resins.

Examples of magnetic powders include magnetic metals such as iron, nickel, and cobalt and magnetic oxides such as ferrite and magnetite.

Examples of coating resins and matrix resins include polyethylene, polypropylene, polystyrene, polyvinyl acetate, polyvinyl alcohol, polyvinyl butyral, polyvinyl chloride, polyvinyl ethers, polyvinyl ketones, vinyl chloride-vinyl acetate copolymers, styrene-acrylate copolymers, straight silicone resins containing organosiloxane bonds and modified products thereof, fluorocarbon resins, polyesters, polycarbonates, phenolic resins, and epoxy resins.

The coating resins and the matrix resins may contain conductive particles and other additives.

Examples of conductive particles include particles of metals such as gold, silver, and copper, carbon black, titanium oxide, zinc oxide, tin oxide, barium sulfate, aluminum borate, and potassium titanate.

An example method for coating the surface of the core with the coating resin is coating with a solution for coating layer formation obtained by dissolving the coating resin and various optional additives in an appropriate solvent. Any solvent may be selected by taking into account factors such as the coating resin used and coating suitability.

Specific methods for coating the core with the coating resin include a dipping method in which the core is dipped in the solution for coating layer formation, a spraying method in which the surface of the core is sprayed with the solution for coating layer formation, a fluidized bed method in which the core is suspended in an air stream and are sprayed with the solution for coating layer formation, and a kneader-coater method in which the carrier core and the solution for coating layer formation are mixed in a kneader-coater and the solvent is removed.

The mixing ratio (mass ratio) of the toner to the carrier in the two-component developer is preferably 1:100 to 30:100, more preferably 3:100 to 20:100.

EXAMPLES

Examples of the present disclosure will now be described, but the present disclosure is not limited to the following examples. In the following description, all parts and percentages are by mass unless otherwise specified.

The viscosity, maximum endothermic peak temperature, and absorbance at predetermined wavelengths of toners are measured by the methods described above.

Developers A1 to A13 and B1 to B3

Preparation of Styrene-Acrylic Resin Particle Dispersion

Preparation of Resin Particle Dispersion (1)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1 part A solution of 4 parts of an anionic surfactant (DOWFAX manufactured by Dow Chemical Company) in 550 parts of ion-exchanged water is put in a flask, and a mixed solution of the above raw materials is added thereto to form an emulsion. A solution of 6 parts of ammonium persulfate in 50 parts of ion-exchanged water is added to the emulsion over 10 minutes with slow stirring. The system is then thoroughly purged with nitrogen and heated to 75° C. in an oil bath to effect polymerization for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 2 parts Next, a mixed solution of these raw materials is emulsified. The emulsion is added to the flask over 120 minutes, and emulsion polymerization is continued for 4 hours. This yields a resin particle dispersion in which resin particles having a weight average molecular weight of 32,000, a glass transition temperature of 53° C., and a volume average particle size of 240 nm are dispersed. Ion-exchanged water is added to the resin particle dispersion to a solids content of 20 mass % to provide a resin particle dispersion (1).

Preparation of Resin Particle Dispersion (2)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1.5 parts A solution of 4 parts of an anionic surfactant (DOWFAX manufactured by Dow Chemical Company) in 550 parts of ion-exchanged water is put in a flask, and a mixed solution of the above raw materials is added thereto to form an emulsion. A solution of 6 parts of ammonium persulfate in 50 parts of ion-exchanged water is added to the emulsion over 10 minutes with slow stirring. The system is then thoroughly purged with nitrogen and heated to 75° C. in an oil bath to effect polymerization for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 2.5 parts Next, a mixed solution of these raw materials is emulsified. The emulsion is added to the flask over 120 minutes, and emulsion polymerization is continued for 4 hours. This yields a resin particle dispersion in which resin particles having a weight-average molecular weight of 30,000, a glass transition temperature of 53° C., and a volume-average particle size of 220 nm are dispersed. Ion-exchanged water is added to the resin particle dispersion to a solids content of 20 mass % to provide a resin particle dispersion (2).

Preparation of Resin Particle Dispersion (3)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1.5 parts A solution of 4 parts of an anionic surfactant (DOWFAX manufactured by Dow Chemical Company) in 550 parts of ion-exchanged water is put in a flask, and a mixed solution of the above raw materials is added thereto to form an emulsion. A solution of 7 parts of ammonium persulfate in 50 parts of ion-exchanged water is added to the emulsion over 10 minutes with slow stirring. The system is then thoroughly purged with nitrogen and heated to 80° C. in an oil bath to effect polymerization for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 3.0 parts Next, a mixed solution of these raw materials is emulsified. The emulsion is added to the flask over 120 minutes, and emulsion polymerization is continued for 4 hours. This yields a resin particle dispersion in which resin particles having a weight-average molecular weight of 28,000, a glass transition temperature of 53° C., and a volume-average particle size of 230 nm are dispersed. Ion-exchanged water is added to the resin particle dispersion to a solids content of 20 mass % to provide a resin particle dispersion (3).

Preparation of Resin Particle Dispersion (4)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 2.0 parts A solution of 4 parts of an anionic surfactant (DOWFAX manufactured by Dow Chemical Company) in 550 parts of ion-exchanged water is put in a flask, and a mixed solution of the above raw materials is added thereto to form an emulsion. A solution of 7.5 parts of ammonium persulfate in 50 parts of ion-exchanged water is added to the emulsion over 10 minutes with slow stirring. The system is then thoroughly purged with nitrogen and heated to 85° C. in an oil bath to effect polymerization for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 3.5 parts Next, a mixed solution of these raw materials is emulsified. The emulsion is added to the flask over 120 minutes, and emulsion polymerization is continued for 4 hours. This yields a resin particle dispersion in which resin particles having a weight average molecular weight of 26,500, a glass transition temperature of 53° C., and a volume average particle size of 210 nm are dispersed. Ion-exchanged water is added to the resin particle dispersion to a solids content of 20 mass % to provide a resin particle dispersion (4).

Preparation of Resin Particle Dispersion (5)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 0.8 parts A solution of 4 parts of an anionic surfactant (DOWFAX manufactured by Dow Chemical Company) in 550 parts of ion-exchanged water is put in a flask, and a mixed solution of the above raw materials is added thereto to form an emulsion. A solution of 5.5 parts of ammonium persulfate in 50 parts of ion-exchanged water is added to the emulsion over 10 minutes with slow stirring. The system is then thoroughly purged with nitrogen and heated to 85° C. in an oil bath to effect polymerization for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 1.7 parts Next, a mixed solution of these raw materials is emulsified. The emulsion is added to the flask over 120 minutes, and emulsion polymerization is continued for 4 hours. This yields a resin particle dispersion in which resin particles having a weight average molecular weight of 36,000, a glass transition temperature of 53° C., and a volume average particle size of 260 nm are dispersed. Ion-exchanged water is added to the resin particle dispersion to a solids content of 20 mass % to provide a resin particle dispersion (5).

Preparation of Magenta-Colored Particle Dispersion

C.I. Pigment Red 122: 50 parts
NEOGEN RK ionic surfactant (manufactured by Dai-Ichi Kogyo Seiyaku Co., Ltd.): 5 parts
Ion-exchanged water: 220 parts These materials are mixed together and processed with an ULTIMIZER (manufactured by Sugino Machine Limited) at 240 MPa for 10 minutes to prepare a magenta-colored particle dispersion (solids content: 20%).

Preparation of Release Agent Particle Dispersion (1)

Ester wax (WEP-2 manufactured by NOF Corporation): 100 parts
Anionic surfactant (NEOGEN RK manufactured by Dai-Ichi Kogyo Seiyaku Co., Ltd.): 2.5 parts
Ion-exchanged water: 250 parts These materials are mixed together and heated to 120° C. The mixture is dispersed using a homogenizer (ULTRA-TURRAX T50 manufactured by IKA), and a dispersion treatment is then performed with a MANTON-GAULIN high-pressure homogenizer (manufactured by Gaulin Corporation) to provide a release agent particle dispersion (1) (solids content: 29.1%) in which release agent particles having a volume average particle size of 330 nm are dispersed.

Preparation of Release Agent Particle Dispersion (2)

Fischer-Tropsch wax (HNP-9 manufactured by Nippon Seiro Co., Ltd.): 100 parts
Anionic surfactant (NEOGEN RK manufactured by Dai-Ichi Kogyo Seiyaku Co., Ltd.): 2.5 parts
Ion-exchanged water: 250 parts These materials are mixed together and heated to 120° C. The mixture is dispersed using a homogenizer (ULTRA-TURRAX T50 manufactured by IKA), and a dispersion treatment is then performed with a MANTON-GAULIN high-pressure homogenizer (manufactured by Gaulin Corporation) to provide a release agent particle dispersion (2) (solids content: 29.2%) in which release agent particles having a volume average particle size of 340 nm are dispersed.

Preparation of Release Agent Particle Dispersion (3)

Paraffin wax (FNP0090 manufactured by Nippon Seiro Co., Ltd.): 100 parts
Anionic surfactant (NEOGEN RK manufactured by Dai-Ichi Kogyo Seiyaku Co., Ltd.): 2.5 parts
Ion-exchanged water: 250 parts These materials are mixed together and heated to 120° C. The mixture is dispersed using a homogenizer (ULTRA-TURRAX T50 manufactured by IKA), and a dispersion treatment is then performed with a MANTON-GAULIN high-pressure homogenizer (manufactured by Gaulin Corporation) to provide a release agent particle dispersion (3) (solids content: 29.0%) in which release agent particles having a volume average particle size of 360 nm are dispersed.

Preparation of Release Agent Particle Dispersion (4)

Polyethylene wax (POLYWAX 725 manufactured by Toyo Adl Corporation): 100 parts
Anionic surfactant (NEOGEN RK manufactured by Dai-Ichi Kogyo Seiyaku Co., Ltd.): 2.5 parts
Ion-exchanged water: 250 parts These materials are mixed together and heated to 100° C. The mixture is dispersed using a homogenizer (ULTRA-TURRAX T50 manufactured by IKA), and a dispersion treatment is then performed with a MANTON-GAULIN high-pressure homogenizer (manufactured by Gaulin Corporation) to provide a release agent particle dispersion (4) (solids content: 29.3%) in which release agent particles having a volume average particle size of 370 nm are dispersed.

Process for Producing Toner A1

Ion-exchanged water: 400 parts
Resin particle dispersion (3): 200 parts
Magenta-colored particle dispersion: 40 parts
Release agent particle dispersion (2): 12 parts
Release agent particle dispersion (3): 24 parts These components are put in a reaction vessel equipped with a thermometer, a pH meter, and a stirrer, and maintained at a temperature of 30° C. and a stirring speed of 150 rpm for 30 minutes while controlling the temperature with an external mantle heater.

The mixture is dispersed with a homogenizer (ULTRA-TURRAX T50 manufactured by IKA Japan) while adding an aqueous PAC solution of 2.1 parts of polyaluminum chloride (PAC, manufactured by Oji Paper Co., Ltd: 30% powder product) in 100 parts of ion-exchanged water. The temperature is then raised to 50° C., and the particle size is measured with a COULTER MULTISIZER II (aperture size: 50 μm, manufactured by Beckman Coulter, Inc.) to determine the volume-average particle size to be 5.0 μm. Thereafter, 115 parts of the resin particle dispersion (1) is additionally added to make the resin particles adhere to the surface of the aggregate particles (to form a shell structure).

Subsequently, 20 parts of a 10 mass % aqueous NTA (nitrilotriacetic acid) metal salt solution (CHELEST 70:

manufactured by Chelest Corporation) is added, and the pH is then adjusted to 9.0 with a 1 N aqueous sodium hydroxide solution. The mixture is then heated to 91° C. at a heating rate of 0.05° C./min and maintained at 91° C. for 3 hours. The resulting toner slurry is then cooled to 85° C. and maintained there for 1 hour. Thereafter, the toner slurry is cooled to 25° C. to obtain a magenta toner. The magenta toner is further washed by repeatedly performing redispersion in ion-exchanged water and filtration until the electrical conductivity of the filtrate reaches or falls below 20 μS/cm. The resultant is then dried under vacuum in an oven at 40° C. for 5 hours to obtain toner particles.

The toner particles obtained (100 parts) are mixed with 1.5 parts of hydrophobic silica (RY50 manufactured by Nippon Aerosil Co., Ltd.) and 1.0 part of hydrophobic titanium oxide (T805 manufactured by Nippon Aerosil Co., Ltd.) by using a sample mill at 10,000 rpm for 30 seconds. The mixture is then sifted through a vibrating sieve with 45-μm openings to prepare a toner A1 (electrostatic image developing toner A1). The toner A1 has a volume average particle size of 5.7 μm.

Preparation of Developer A1

The toner A1 (8 parts) is blended with a carrier (92 parts) by using a V-blender to prepare a developer A1 (electrostatic image developer A1).

Preparation of Developers A2 to A13 and B1 and B2

Toners A2 to A13 and toners B1 and B2, which are magenta toners, are obtained in the same manner as the toner A1 except that the resin particle dispersion, the release agent particle dispersion, the amount of aggregating agent, the coalescence temperature, the retention temperature, and the retention time are changed as shown in Table 1.

Developers A2 to A13 and developers B1 and B2, which are electrostatic image developers, are prepared in the same manner as the developer A1 except that the toners A2 to A13 and the toners B1 and B2 are respectively used.

Preparation of Developer B3

A toner B3, which is a magenta toner, is obtained in the same manner as the toner A1 except that the resin particle dispersion, the release agent particle dispersion, the amount of aggregating agent, the coalescence temperature, the retention temperature, and the retention time are changed as shown in Table 1.

A developer B3, which is an electrostatic image developer, is prepared in the same manner as the developer A1 except that the toner B3 is used.

TABLE 1

| Toner | (In η(T1)-In η(T2))/(T1-T2) | (In η(T2)-In η(T3))/(T2-T3) | (In η(T0)-In η(T1))/(T0-T1) | (In η(T2)-In η(T3))/(T2-T3) (In η(T1)-In η(T2))/(T1-T2) | (In η(T0)-In η(T1))/(T0-T1) (In η(T1)-In η(T2))/(T1-T2) | Maximum endothermic peak temperature of toner (° C.) | a/b | c/d |
|---|---|---|---|---|---|---|---|---|
| A1 | −0.215 | −0.090 | −0.110 | 0.125 | 0.105 | 85 | 5.0 | 2.9 |
| A2 | −0.168 | −0.080 | −0.085 | 0.088 | 0.083 | 85 | 5.1 | 2.5 |
| A3 | −0.143 | −0.100 | −0.078 | 0.043 | 0.065 | 85 | 4.9 | 2.6 |
| A4 | −0.213 | −0.090 | −0.106 | 0.123 | 0.107 | 85 | 5.0 | 2.8 |
| A5 | −0.214 | −0.100 | −0.110 | 0.114 | 0.104 | 85 | 5.1 | 2.4 |
| A6 | −0.154 | −0.135 | −0.077 | 0.019 | 0.077 | 70 | 5.1 | 2.6 |
| A7 | −0.153 | −0.133 | −0.080 | 0.020 | 0.073 | 100 | 4.9 | 2.8 |
| A8 | −0.155 | −0.141 | −0.083 | 0.014 | 0.072 | 63 | 5.0 | 2.5 |
| A9 | −0.156 | −0.136 | −0.079 | 0.020 | 0.077 | 102 | 5.1 | 2.9 |
| A10 | −0.152 | −0.141 | −0.073 | 0.011 | 0.079 | 85 | 1.5 | 1.3 |
| A11 | −0.153 | −0.142 | −0.071 | 0.011 | 0.082 | 85 | 7.2 | 3.5 |
| A12 | −0.155 | −0.135 | −0.075 | 0.020 | 0.080 | 85 | 8.5 | 4.5 |
| A13 | −0.154 | −0.134 | −0.078 | 0.020 | 0.076 | 85 | 0.7 | 0.6 |
| B1 | −0.129 | −0.090 | −0.068 | 0.039 | 0.061 | 85 | 5.3 | 2.9 |
| B2 | −0.215 | −0.155 | −0.113 | 0.060 | 0.102 | 85 | 5.3 | 2.9 |
| B3 | −0.180 | −0.186 | −0.109 | −0.006 | 0.071 | 85 | 5.3 | 2.9 |

| Toner | Resin particle dispersion | First release agent particle dispersion | | Second release agent particle dispersion | | Conditions for producing toner | | | |
|---|---|---|---|---|---|---|---|---|---|
| | | Type | Parts | Type | Parts | Amount of aggregating agent (parts) | Coalescence temperature (° C.) | Retention temperature (° C.) | Retention time (hr) |
| A1 | (3) | (2) | 12 | (3) | 24 | 2.1 | 91 | 85 | 1 |
| A2 | (2) | (2) | 12 | (3) | 24 | 2.1 | 92 | 85 | 1 |
| A3 | (1) | (2) | 12 | (3) | 24 | 2.1 | 93 | 85 | 1 |
| A4 | (3) | (2) | 12 | (3) | 24 | 1.9 | 92 | 85 | 1 |
| A5 | (3) | (2) | 12 | (3) | 24 | 1.7 | 91 | 85 | 1 |
| A6 | (1) | (1) | 12 | (2) | 24 | 1.7 | 77 | 70 | 1 |
| A7 | (1) | (3) | 12 | (4) | 24 | 1.7 | 108 | 95 | 1 |
| A8 | (1) | (1) | 28.8 | (2) | 7.2 | 1.7 | 70 | 65 | 1 |
| A9 | (1) | (3) | 7.2 | (4) | 28.8 | 1.7 | 108 | 95 | 1 |
| A10 | (1) | (2) | 12 | (3) | 24 | 1.7 | 91 | 85 | 0.5 |
| A11 | (1) | (2) | 12 | (3) | 24 | 1.7 | 92 | 85 | 2 |
| A12 | (1) | (2) | 12 | (3) | 24 | 1.7 | 93 | 85 | 3 |
| A13 | (1) | (2) | 12 | (3) | 24 | 1.7 | 92 | 85 | 0.25 |
| B1 | (5) | (2) | 12 | (3) | 24 | 2.1 | 91 | 85 | 1 |
| B2 | (3) | (2) | 12 | (3) | 24 | 1.5 | 93 | 85 | 1 |
| B3 | (4) | (2) | 12 | (3) | 24 | 2.1 | 93 | 85 | 1 |

Examples 1 to 13 and Comparative Examples 1 to 3

Developers shown in Table 2 are each loaded into a developing device of an image forming apparatus (a modified DOCUCENTRE-IV C5570 machine manufactured by Fuji Xerox Co., Ltd). The modified machine is provided with a collected toner transport path for supplying (transporting) collected toner from a cleaning device to the developing device, the collected toner being removed from a photoreceptor with a cleaning blade after a toner image is transferred from the photoreceptor. The collected toner transport path is connected to a replenishment toner transport path for transporting replenishment toner from a toner cartridge, so that collected toner and replenishment toner (i.e., unused toner) are mixed together and supplied to the developing device.

Evaluation of Unevenness in Image Density

An image with an area coverage of 30% is output on 100 sheets in a low-temperature and low-humidity environment (10° C. and 15% RH). Randomly selected ten output images are measured with an X-Rite 938 image density meter (manufactured by X-Rite, Incorporated), and the difference in image density, which is a difference between a maximum measured density and a minimum measured density, is determined to evaluate unevenness in image density according to the following criteria.

Criteria for Evaluating Unevenness in Image Density

A: Difference in image density is 0.2 or less.

B: Difference in image density is more than 0.2 and 0.25 or less.

C: Difference in image density is more than 0.25 and 0.3 or less.

D: Difference in image density is more than 0.3.

Evaluation of Decrease in Image Density

An image with an area coverage of 1% is output on 100 sheets in a high-temperature and high-humidity environment (28° C. and 85% RH). The first image and the 100th image are compared with each other by visual observation to evaluate image quality according to the following criteria.

Criteria for evaluating decrease in image density

A: Image density is not decreased.

B: Image density is slightly decreased.

C: Image density is decreased (at acceptable level).

D: Image density is greatly decreased (at unacceptable level).

TABLE 2

| | | Developer | 10° C. and 15% RH Unevenness in image density | 28° C. and 85% RH Decrease in image density |
|---|---|---|---|---|
| Example | 1 | A1 | A | C |
| | 2 | A2 | A | C |
| | 3 | A3 | B | B |
| | 4 | A4 | A | C |
| | 5 | A5 | A | C |
| | 6 | A6 | B | B |
| | 7 | A7 | B | B |
| | 8 | A8 | A | C |
| | 9 | A9 | B | B |
| | 10 | A10 | C | A |
| | 11 | A11 | C | A |
| | 12 | A12 | C | B |
| | 13 | A13 | B | B |
| Comparative example | 1 | B1 | D | A |
| | 2 | B2 | A | D |
| | 3 | B3 | D | A |

Developers A101 to A113 and B101 to B103

Preparation of Amorphous Polyester Resin Particle Dispersion

Preparation of Resin Particle Dispersion (101)

Sixty parts of dimethyl terephthalate, 74 parts of dimethyl fumarate, 30 parts of dodecenylsuccinic anhydride, 22 parts of trimellitic acid, 138 parts of propylene glycol, and 0.3 parts of dibutyltin oxide are put in a three-necked flask whose inside is dried. In a nitrogen atmosphere, the mixture is allowed to react at 185° C. for 3 hours while water formed by the reaction is removed from the system. Thereafter, the temperature is raised to 240° C. while the pressure is gradually reduced. The mixture is further allowed to react for 4 hours and then cooled. In this manner, an amorphous polyester resin (101) having a weight average molecular weight of 39,000 is prepared.

Next, 200 parts of the amorphous polyester resin (101) from which insoluble matter has been removed, 100 parts of methyl ethyl ketone, 35 parts of isopropyl alcohol, and 7.0 parts of a 10 mass % aqueous ammonia solution are put in a separable flask and thoroughly mixed to form a solution. While the solution is stirred and heated at 40° C., ion-exchanged water is added dropwise using a feed pump at a feed rate of 8 g/min. After the solution becomes cloudy with high homogeneity, the feed rate is increased to 15 g/min to cause phase inversion. The dropwise addition is stopped when the amount of feeding reaches 580 parts. Thereafter, the solvent is removed under reduced pressure to obtain an amorphous polyester resin particle dispersion (101) (a resin particle dispersion (101)). The polyester resin particles obtained have a volume-average particle size of 170 nm and a solids content of 35%.

Preparation of resin particle dispersions (102) to (105)

Resin particle dispersions (102) to (105) are prepared in the same manner as the resin particle dispersion (101) except that the conditions are changed as shown in Table 3.

TABLE 3

| | Resin polymerization time | Weight-average molecular weight of polyester resin |
|---|---|---|
| Amorphous polyester resin particle dispersion (101) | 3 hrs at 185° C., 4 hrs at 240° C. | 39,000 |
| Amorphous polyester resin particle dispersion (102) | 2.5 hrs at 185° C., 3.5 hrs at 240° C. | 37,000 |
| Amorphous polyester resin particle dispersion (103) | 2 hrs at 185° C., 3 hrs at 240° C. | 35,000 |
| Amorphous polyester resin particle dispersion (104) | 1.5 hrs at 185° C., 2.5 hrs at 240° C. | 33,000 |
| Amorphous polyester resin particle dispersion (105) | 4 hrs at 185° C., 5 hrs at 240° C. | 43,000 |

Process for producing toner A101

Ion-exchanged water: 400 parts

Amorphous polyester resin particle dispersion (103): 200 parts

Magenta-colored particle dispersion: 40 parts

Release agent particle dispersion (2): 12 parts

Release agent particle dispersion (3): 24 parts

These components are put in a reaction vessel equipped with a thermometer, a pH meter, and a stirrer, and maintained at a temperature of 30° C. and a stirring speed of 150 rpm for 30 minutes while controlling the temperature with an external mantle heater.

The mixture is dispersed with a homogenizer (ULTRA-TURRAX T50 manufactured by IKA Japan) while adding an aqueous PAC solution of 2.1 parts of polyaluminum chloride (PAC, manufactured by Oji Paper Co., Ltd: 30% powder product) in 100 parts of ion-exchanged water. The temperature is then raised to 50° C., and the particle size is measured with a COULTER MULTISIZER II (aperture size: 50 μm, manufactured by Beckman Coulter, Inc.) to determine the volume-average particle size to be 4.9 μm. Thereafter, 115 parts of the amorphous polyester resin particle dispersion (101) is additionally added to make the resin particles adhere to the surface of the aggregate particles (to form a shell structure).

Subsequently, 20 parts of a 10 mass % aqueous NTA (nitrilotriacetic acid) metal salt solution (CHELEST 70: manufactured by Chelest Corporation) is added, and the pH is then adjusted to 9.0 with a 1 N aqueous sodium hydroxide solution. The mixture is then heated to 91° C. at a heating rate of 0.05° C./min and maintained at 91° C. for 3 hours. The resulting toner slurry is then cooled to 85° C. and maintained there for 1 hour. Thereafter, the toner slurry is cooled to 25° C. to obtain a magenta toner. The magenta toner is further washed by repeatedly performing redispersion in ion-exchanged water and filtration until the electrical conductivity of the filtrate reaches or falls below 20 μS/cm. The resultant is then dried under vacuum in an oven at 40° C. for 5 hours to obtain toner particles.

The toner particles obtained (100 parts) are mixed with 1.5 parts of hydrophobic silica (RY50 manufactured by Nippon Aerosil Co., Ltd.) and 1.0 part of hydrophobic titanium oxide (T805 manufactured by Nippon Aerosil Co., Ltd.) by using a sample mill at 10,000 rpm for 30 seconds. The mixture is then sifted through a vibrating sieve with 45-μm openings to prepare a toner A101 (electrostatic image developing toner A101). The toner A101 has a volume-average particle size of 5.8 μm.

Preparation of Developer A101

The toner A101 (8 parts) is blended with a carrier (92 parts) by using a V-blender to prepare a developer A101 (electrostatic image developer A101).

Preparation of Developers A102 to A113 and B101 and B102

Toners A102 to A113 and toners B101 and B102, which are magenta toners, are obtained in the same manner as the toner A101 except that the resin particle dispersion, the release agent particle dispersion, the amount of aggregating agent, the coalescence temperature, the retention temperature, and the retention time are changed as shown in Table 4.

Developers A102 to A113 and developers B101 and B102, which are electrostatic image developers, are prepared in the same manner as the developer A101 except that the toners A102 to A113 and the toners B101 and B102 are respectively used.

Preparation of Developer B103

A toner B103, which is a magenta toner, is obtained in the same manner as the toner A101 except that the resin particle dispersion, the release agent particle dispersion, the amount of aggregating agent, the coalescence temperature, the retention temperature, and the retention time are changed as shown in Table 4.

A developer B103, which is an electrostatic image developer, is prepared in the same manner as the developer A101 except that the toner B103 is used.

TABLE 4

| Toner | (In η(T1)-In η(T2))/(T1-T2) | (In η(T2)-In η(T3))/(T2-T3) | (In η(T0)-In η(T1))/(T0-T1) | (In η(T2)-In η(T3))/(T2-T3) (In η(T1)-In η(T2))/(T1-T2) | (In η(T0 - In η(T1))/(T0-T1) (In η(T1)-In η(T2))/(T1-T2) | Maximum endothermic peak temperature of toner (° C.) | a/b | c/d | 1,500 $cm^{-1}$/720 $cm^{-1}$ |
|---|---|---|---|---|---|---|---|---|---|
| A101 | −0.220 | −0.110 | −0.100 | 0.110 | 0.120 | 85 | 5.2 | 2.7 | 0.30 |
| A102 | −0.163 | −0.070 | −0.080 | 0.093 | 0.083 | 85 | 4.9 | 2.3 | 0.31 |
| A103 | −0.141 | −0.100 | −0.065 | 0.041 | 0.076 | 85 | 4.8 | 2.7 | 0.29 |
| A104 | −0.222 | −0.080 | −0.111 | 0.142 | 0.111 | 85 | 5.2 | 2.7 | 0.33 |
| A105 | −0.211 | −0.110 | −0.101 | 0.101 | 0.110 | 85 | 5.0 | 2.5 | 0.34 |
| A106 | −0.156 | −0.131 | −0.075 | 0.025 | 0.081 | 70 | 4.9 | 2.4 | 0.30 |
| A107 | −0.154 | −0.135 | −0.072 | 0.019 | 0.082 | 100 | 4.7 | 2.9 | 0.29 |
| A108 | −0.155 | −0.139 | −0.079 | 0.016 | 0.076 | 85 | 1.6 | 1.4 | 0.33 |
| A109 | −0.154 | −0.141 | −0.077 | 0.013 | 0.077 | 85 | 7.1 | 3.3 | 0.29 |
| A110 | −0.151 | −0.136 | −0.072 | 0.015 | 0.079 | 63 | 5.2 | 2.9 | 0.27 |
| A111 | −0.153 | −0.140 | −0.081 | 0.013 | 0.072 | 102 | 5.1 | 2.5 | 0.34 |
| A112 | −0.152 | −0.133 | −0.080 | 0.019 | 0.072 | 85 | 8.6 | 4.6 | 0.33 |
| A113 | −0.151 | −0.133 | −0.071 | 0.018 | 0.080 | 85 | 0.8 | 0.5 | 0.31 |
| B101 | −0.127 | −0.110 | −0.055 | 0.017 | 0.072 | 85 | 5.0 | 2.7 | 0.34 |
| B102 | −0.221 | −0.160 | −0.132 | 0.061 | 0.089 | 85 | 5.1 | 2.8 | 0.28 |
| B103 | −0.203 | −0.224 | −0.119 | −0.021 | 0.084 | 85 | 5.3 | 3.0 | 0.36 |

| | | | | | | | Conditions for producing toner | | | |
|---|---|---|---|---|---|---|---|---|---|---|
| | | | First release agent particle dispersion | | Second release agent particle dispersion | | | | | |
| Toner | 820 $cm^{-1}$/720 $cm^{-1}$ | Resin particle dispersion | Type | Parts | Type | Parts | Amount of aggregating agent (parts) | Coalescence temperature (° C.) | Retention temperature (° C.) | Retention time (hr) |
| A101 | 0.16 | (103) | (2) | 12 | (3) | 24 | 2.1 | 91 | 85 | 1 |
| A102 | 0.15 | (102) | (2) | 12 | (3) | 24 | 2.1 | 92 | 85 | 1 |
| A103 | 0.17 | (101) | (2) | 12 | (3) | 24 | 2.1 | 93 | 85 | 1 |
| A104 | 0.16 | (103) | (2) | 12 | (3) | 24 | 1.9 | 92 | 85 | 1 |
| A105 | 0.17 | (103) | (2) | 12 | (3) | 24 | 1.7 | 91 | 85 | 1 |
| A106 | 0.16 | (101) | (1) | 12 | (2) | 24 | 1.7 | 77 | 70 | 1 |
| A107 | 0.15 | (101) | (3) | 12 | (4) | 24 | 1.7 | 108 | 95 | 1 |
| A108 | 0.17 | (101) | (2) | 12 | (3) | 24 | 1.7 | 91 | 85 | 0.5 |

TABLE 4-continued

| | | | | | | | | | | |
|---|---|---|---|---|---|---|---|---|---|---|
| A109 | 0.18 | (101) | (2) | 12 | (3) | 24 | 1.7 | 92 | 85 | 2 |
| A110 | 0.16 | (103) | (1) | 28.8 | (2) | 7.2 | 1.7 | 70 | 65 | 1 |
| A111 | 0.17 | (103) | (3) | 7.2 | (4) | 28.8 | 1.7 | 108 | 95 | 1 |
| A112 | 0.16 | (103) | (2) | 12 | (3) | 24 | 1.7 | 93 | 85 | 3 |
| A113 | 0.15 | (103) | (2) | 12 | (3) | 24 | 1.7 | 92 | 85 | 0.25 |
| B101 | 0.16 | (105) | (2) | 12 | (3) | 24 | 2.1 | 91 | 85 | 1 |
| B102 | 0.18 | (103) | (2) | 12 | (3) | 24 | 1.5 | 93 | 85 | 1 |
| B103 | 0.17 | (104) | (2) | 12 | (3) | 24 | 1.5 | 93 | 85 | 1 |

Examples 101 to 113 and Comparative Examples 101 to 113

Developers shown in Table 5 are each loaded into a developing device of an image forming apparatus (a modified DOCUCENTRE-IV C5570 machine manufactured by Fuji Xerox Co., Ltd). The modified machine is provided with a collected toner transport path for supplying (transporting) collected toner from a cleaning device to the developing device, the collected toner being removed from a photoreceptor with a cleaning blade after a toner image is transferred from the photoreceptor. The collected toner transport path is connected to a replenishment toner transport path for transporting replenishment toner from a toner cartridge, so that collected toner and replenishment toner (i.e., unused toner) are mixed together and supplied to the developing device.

Evaluation of Unevenness in Image Density

An image with an area coverage of 30% is output on 100 sheets in a low-temperature and low-humidity environment (10° C. and 15% RH). Randomly selected ten output images are measured with an X-Rite 938 image density meter (manufactured by X-Rite, Incorporated), and the difference in image density, which is a difference between a maximum measured density and a minimum measured density, is determined to evaluate unevenness in image density according to the following criteria.

Criteria for Evaluating Unevenness in Image Density

A: Difference in image density is 0.2 or less.

B: Difference in image density is more than 0.2 and 0.25 or less.

C: Difference in image density is more than 0.25 and 0.3 or less.

D: Difference in image density is more than 0.3.

Evaluation of Decrease in Image Density

An image with an area coverage of 1% is output on 100 sheets in a high-temperature and high-humidity environment (28° C. and 85% RH). The first image and the 100th image are compared with each other by visual observation to evaluate image quality according to the following criteria.

Criteria for Evaluating Decrease in Image Density

A: Image density is not decreased.

B: Image density is slightly decreased.

C: Image density is decreased (at acceptable level).

D: Image density is greatly decreased (at unacceptable level).

TABLE 5

| | | Developer | 10° C. and 15% RH Unevenness in image density | 28° C. and 85% RH Decrease in image density |
|---|---|---|---|---|
| Example | 101 | A101 | A | C |
| | 102 | A102 | B | B |
| | 103 | A103 | C | A |
| | 104 | A104 | A | C |

TABLE 5-continued

| | | Developer | 10° C. and 15% RH Unevenness in image density | 28° C. and 85% RH Decrease in image density |
|---|---|---|---|---|
| | 105 | A105 | A | C |
| | 106 | A106 | B | B |
| | 107 | A107 | B | A |
| | 108 | A108 | B | B |
| | 109 | A109 | B | B |
| | 110 | A110 | B | B |
| | 111 | A111 | A | C |
| | 112 | A112 | B | C |
| | 113 | A113 | C | A |
| Comparative example | 101 | B101 | D | A |
| | 102 | B102 | A | D |
| | 103 | B103 | D | A |

The above shows that when image forming apparatuses of Examples, in each of which a toner satisfying conditions $(\ln \eta(T1)-\ln \eta(T2))/(T1-T2) \leq -0.14$, $(\ln \eta(T2)-\ln \eta(T3))/(T2-T3) \geq -0.15$, and $(\ln \eta(T2)-\ln \eta(T3))/(T2-T3) > (\ln \eta(T1)-\ln \eta(T2))/(T1-T2)$ is used, are used, a decrease in image density is less likely to occur when an image with a low area coverage is formed in a high-temperature and high-humidity environment, and at the same time, unevenness in image density is less likely to occur when an image with a low area coverage is formed in a low-temperature and low-humidity environment, as compared to when image forming apparatuses of Comparative Examples, in each of which a toner not satisfying at least one of these conditions is used, are used.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier;

a charging unit that charges a surface of the image carrier;

an electrostatic image forming unit that forms an electrostatic image on the charged surface of the image carrier;

a developing unit that contains an electrostatic image developing toner and develops the electrostatic image formed on the surface of the image carrier with the electrostatic image developing toner to form a toner image;

a transfer unit that transfers the toner image formed on the surface of the image carrier to a recording medium;

a cleaning unit that removes the electrostatic image developing toner remaining on the surface of the image carrier;

a first supply unit that has a replenishment toner transport path for transporting a replenishment toner for the electrostatic image developing toner and supplies the replenishment toner to the developing unit;

a second supply unit that collects the electrostatic image developing toner removed by the cleaning unit, that has a collected toner transport path for transporting the collected toner to the developing unit, and that supplies the collected toner to the developing unit; and a fixing unit that fixes the toner image transferred to the recording medium, wherein the electrostatic image developing toner contains toner particles and an external additive and satisfies inequalities below:

$(\ln>(T1)-\ln \eta(T2))/(T1-T2)\leq-0.14$ $(\ln \eta(T2)-\ln>(T3))/(T2-T3)\geq-0.15$ $(\ln \eta(T1)-\ln \eta(T2))/(T1-T2)<(\ln \eta(T2)-\ln \eta(T3))/(T2-T3)$ wherein $\eta(T1)$ represents a viscosity of the electrostatic image developing toner at 60° C., $\eta(T2)$ represents a viscosity of the electrostatic image developing toner at 90° C., and $\eta(T3)$ represents a viscosity of the electrostatic image developing toner at 130° C.

2. The image forming apparatus according to claim 1, wherein the electrostatic image developing toner satisfies $(\ln \eta(T0)-\ln \eta(T1))/(T0-T1)\geq-0.12$ and $(\ln \eta(T0)-\ln \eta(T1))/(T0-T1)>(\ln \eta(T1)-\ln \eta(T2))/(T1-T2)$, wherein $\eta(T0)$ is a viscosity $\eta$ of the electrostatic image developing toner at temperature T0=40° C.

3. The image forming apparatus according to claim 1, wherein the electrostatic image developing toner satisfies the following inequality:

$(\ln \eta(T1)-\ln \eta(T2))/(T1-T2)\leq-0.16$.

4. The image forming apparatus according to claim 1, wherein the electrostatic image developing toner satisfies the following inequality:

$(\ln \eta(T2)-\ln \eta(T3))/(T2-T3)\geq-0.13$.

5. The image forming apparatus according to claim 1, wherein the electrostatic image developing toner contains a release agent, and the electrostatic image developing toner satisfies the following inequality:

$1.0<a/b<8.0$ wherein a is a number of domains formed of the release agent and having an aspect ratio of 5 or more in the electrostatic image developing toner, and b is a number of domains formed of the release agent and having an aspect ratio of less than 5 in the electrostatic image developing toner.

6. The image forming apparatus according to claim 1, wherein the electrostatic image developing toner contains a release agent, and the electrostatic image developing toner satisfies the following inequality:

$1.0<c/d<4.0$ wherein c is an area of domains formed of the release agent and having an aspect ratio of 5 or more in the electrostatic image developing toner, and d is an area of domains formed of the release agent and having an aspect ratio of less than 5 in the electrostatic image developing toner.

7. The image forming apparatus according to claim 1, wherein the electrostatic image developing toner has a maximum endothermic peak temperature in a range of 70° C. to 100° C.

8. The image forming apparatus according to claim 1, wherein the electrostatic image developing toner has a maximum endothermic peak temperature in a range of 75° C. to 95° C.

9. The image forming apparatus according to claim 1, wherein the electrostatic image developing toner contains a styrene-acrylic resin serving as a binder resin.

10. The image forming apparatus according to claim 1, wherein the electrostatic image developing toner contains an amorphous polyester resin serving as a binder resin.

11. The image forming apparatus according to claim 1, wherein the external additive is a metal oxide.

12. The image forming apparatus according to claim 11, wherein the metal oxide contains at least one of titania particles and silica particles.

13. The image forming apparatus according to claim 1, wherein the external additive is added in an amount of 0.01 mass % to 10 mass % based on an amount of the toner particles.

14. The image forming apparatus according to claim 1, wherein the first supply unit and the second supply unit have a junction where the replenishment toner transport path and the collected toner transport path are connected together, and the replenishment toner and the collected toner are supplied through the junction to the developing unit.

15. The image forming apparatus according to claim 14, wherein the first supply unit and the second supply unit are disposed so as to be inclined relative to a horizontal plane such that the collected toner transport path is located above the replenishment toner transport path, and a replenishment toner transporting member that transports the replenishment toner is disposed inside the replenishment toner transport path.

16. The image forming apparatus according to claim 14, wherein the first supply unit and the second supply unit are disposed so as to be inclined relative to a horizontal plane such that the replenishment toner transport path is located above the collected toner transport path, and a collected toner transporting member that transports the collected toner is disposed inside the collected toner transport path.

17. The image forming apparatus according to claim 14, wherein the first supply unit includes a replenishment toner transporting member inside the replenishment toner transport path, and the second supply unit includes a collected toner transporting member inside the collected toner transport path, the replenishment toner transporting member and the collected toner transporting member being provided as a single shaft.

* * * * *